US008943719B1

(12) United States Patent
Post-Smith et al.

(10) Patent No.: US 8,943,719 B1
(45) Date of Patent: Feb. 3, 2015

(54) METHOD AND APPARATUS FOR MARKETING GREETING CARDS

(75) Inventors: Julie Post-Smith, Cleveland, OH (US); Steve Laserson, Cleveland, OH (US); Anne Marie Thomas, Cleveland, OH (US); Margey Lowery, Cleveland, OH (US); Sharon Schneider, Cleveland, OH (US); Carly Price, San Francisco, CA (US); Valeria Cardoso, San Francisco, CA (US); Christian Schmidt, San Francisco, CA (US); Mark Jones, San Francisco, CA (US); Paul Mougey, San Francisco, CA (US); Travis Lee, San Francisco, CA (US); John Grimley, San Francisco, CA (US); Jay Highland, Columbus, OH (US); Katie Doran, Columbus, OH (US); Lori Mukoyama, Columbus, OH (US)

(73) Assignee: American Greetings Corporation, Cleveland, OH (US)

( * ) Notice: Subject to any disclaimer, the term of this patent is extended or adjusted under 35 U.S.C. 154(b) by 1775 days.

(21) Appl. No.: 11/654,382

(22) Filed: Jan. 17, 2007

Related U.S. Application Data

(60) Provisional application No. 60/759,690, filed on Jan. 17, 2006.

(51) Int. Cl.
*G09F 1/10* (2006.01)
*A47F 7/00* (2006.01)

(52) U.S. Cl.
CPC .... *G09F 1/10* (2013.01); *A47F 7/00* (2013.01)
USPC ..... 40/124; 211/144; 211/49.1; 211/50; 211/55; 211/59.2; 40/500

(58) Field of Classification Search
USPC ..... 211/55; 362/127; 40/500
See application file for complete search history.

(56) References Cited

U.S. PATENT DOCUMENTS

| | | | | | |
|---|---|---|---|---|---|
| 320,949 | A | | 6/1885 | McElroy | |
| 759,140 | A | | 5/1904 | Thompson | |
| 835,615 | A | | 11/1906 | Henricks | |
| 978,995 | A | | 12/1910 | Ellis | |
| 1,455,192 | A | | 5/1923 | Dumont | |
| 1,556,514 | A | | 10/1925 | Feldman | |
| 1,637,535 | A | | 8/1927 | Rand | |
| 1,672,633 | A | | 6/1928 | Vogel | |
| 1,881,212 | A | * | 10/1932 | McKelvey | 211/85.17 |
| 1,948,738 | A | | 2/1934 | Thayer | |
| 2,002,128 | A | | 5/1935 | Reidenbaugh | |
| 2,067,051 | A | * | 1/1937 | Hall | 211/55 |
| 2,119,609 | A | | 6/1938 | Stiles | |
| 2,333,717 | A | * | 11/1943 | Heed et al. | 312/50 |

(Continued)

FOREIGN PATENT DOCUMENTS

EP 0198477 10/1986

*Primary Examiner* — Shin Kim

(57) ABSTRACT

Greeting cards can be organized into multiple sender profiles. Greeting cards for each profile are displayed in one or more displays. The display can include one or more tiered display panels. Each tiered display panel can include multiple rows of pockets for displaying greeting cards in a full-facing or partial facing manner and captions at one or more of the pockets to display the internal content of the greeting cards. The display also can include a display panel identifying the sender profile associated with the apparatus. Each sender profile can be assigned a unique color which is applied to the display panel associated with the respective sender profile.

1 Claim, 21 Drawing Sheets

(56) References Cited

U.S. PATENT DOCUMENTS

| | | | | |
|---|---|---|---|---|
| 2,791,048 | A | 5/1957 | Caller | |
| 2,943,742 | A | 7/1960 | Colley | |
| 3,055,507 | A | 9/1962 | Kobs | |
| 3,302,797 | A | 2/1967 | Kolster | |
| 3,741,617 | A | 6/1973 | Gloyd | |
| 3,747,242 | A | 7/1973 | Heimann | |
| 3,777,897 | A | 12/1973 | Gray | |
| 3,821,538 | A | 6/1974 | Jonathan | |
| 3,838,266 | A | 9/1974 | Jonathan et al. | |
| 3,886,348 | A | 5/1975 | Jonathan et al. | |
| 3,892,450 | A | 7/1975 | Kolster et al. | |
| 3,908,830 | A | 9/1975 | Skrzelowski | |
| 3,983,649 | A | 10/1976 | Ellis et al. | |
| D265,024 | S | 6/1982 | Johnson et al. | |
| 4,460,097 | A * | 7/1984 | Darnell et al. | 211/189 |
| 4,613,047 | A | 9/1986 | Bushyhead et al. | |
| 4,621,878 | A | 11/1986 | Johnson et al. | |
| 4,655,353 | A | 4/1987 | Johnson et al. | |
| 4,744,473 | A | 5/1988 | Hardy | |
| D296,283 | S | 6/1988 | Hardy | |
| 4,905,845 | A | 3/1990 | Broeker et al. | |
| 4,925,038 | A * | 5/1990 | Gajewski | 211/59.2 |
| 4,949,849 | A | 8/1990 | Hardy | |
| D332,883 | S | 2/1993 | Staude | |
| D351,076 | S | 10/1994 | Eliadis et al. | |
| 5,423,617 | A | 6/1995 | Marsh et al. | |
| 5,445,272 | A | 8/1995 | Crisp | |
| D370,140 | S | 5/1996 | Gaietto | |
| 5,620,103 | A | 4/1997 | Vlah et al. | |
| 5,720,396 | A | 2/1998 | Wegscheid et al. | |
| 5,758,781 | A | 6/1998 | Lord et al. | |
| 5,915,571 | A | 6/1999 | Czalkiewicz et al. | |
| D412,253 | S | 7/1999 | Brozak, Jr. | |
| 5,938,048 | A | 8/1999 | Carroll et al. | |
| 6,068,139 | A | 5/2000 | Brozak, Jr. | |
| D430,758 | S | 9/2000 | Skrzelowksi | |
| 6,170,674 | B1 | 1/2001 | Caterinacci | |
| 6,336,564 | B1 | 1/2002 | Garnier | |
| 6,427,853 | B2 | 8/2002 | Brozak, Jr. | |
| 6,431,371 | B1 | 8/2002 | Tonon | |
| 6,530,485 | B1 | 3/2003 | Weber | |
| 6,619,767 | B2 | 9/2003 | Conway | |
| D497,269 | S | 10/2004 | Richardson et al. | |
| D497,495 | S | 10/2004 | Richardson et al. | |
| D530,940 | S | 10/2006 | Raile | |
| D537,274 | S | 2/2007 | Pirro et al. | |
| 7,249,430 | B2 | 7/2007 | Kerker et al. | |
| 2001/0025823 | A1 | 10/2001 | Brozak | |
| 2007/0170126 | A1 | 7/2007 | Singer | |
| 2008/0078728 | A1 | 4/2008 | Hodge | |

* cited by examiner

METHOD AND APPARATUS FOR MARKETING GREETING CARDS

STATEMENT OF RELATED PATENT APPLICATION

This non-provisional patent application claims priority under 35 U.S.C. §119 to U.S. Provisional Patent Application No. 60/759,690, titled Method and Apparatus For Increasing Greeting Card Sales, filed Jan. 17, 2006. This provisional application is hereby fully incorporated herein by reference.

FIELD OF THE INVENTION

This invention relates to display racks or assemblies for displaying merchandise, such as greeting cards. More specifically, the invention relates to displaying cards on a display rack that assist greeting card consumers in distinguishing between groups of greeting cards based on the purchasing aspects of consumers.

BACKGROUND OF THE INVENTION

Retail displays of greeting cards have typically organized cards by occasion (such as Birthday, Wedding, Mother's Day, Valentine's Day, etc.) in a standardized arrangement. However, different types of people have different needs and preferences when selecting a greeting card. By organizing all of the cards in one occasion together, it makes it difficult and time consuming for a consumer to find a card that she wants to purchase. The more time consuming the task of purchasing a greeting card becomes, the less likely a consumer will make the effort to purchase greeting cards. On the other hand, if the greeting cards were initially organized based on certain consumer preferences and then by occasion, the consumer could select the group of consumer preferences that best describe her and search for cards in the portion of the display that contains greeting cards that are more likely to be desirable to her.

The traditional display of greeting cards also makes the consumer's experience in purchasing greeting cards a time consuming process. Conventional greeting card displays have changed little over the years. Most display a majority of their greeting cards in a partial-facing manner so that the consumer can only see a portion (generally the top half) of the card while it is in the display. Partial-facing displays are generally preferred because they allow for a greater number of cards in a fixed amount of shelf space. Unfortunately, partial-facing displays force the consumer to remove the greeting card to determine if the art and copy on the front of the card is appropriate. If not, the consumer generally will not take the time to review the interior art and copy of the greeting card. If a display was designed to present a greater percentage of cards in a full-facing manner the consumer would be able to more quickly determine the cards she is interested in purchasing. In addition, by placing additional information about the greeting card, for example, the internal copy of the card, near the card in the display, the consumer's selection time can be further reduced because the consumer would not have to open the card to determine if she likes the interior copy of the greeting card.

In addition, since the greeting cards in a conventional card display are typically presented in the same manner, there are no visual cues alerting the consumer to cards that are trendy, represent emerging trends, or worthy of closer review. While those cards may be in the display, the consumer must "hunt and peck" to find them.

Therefore, there is a need in the art for a display assembly that effectively displays a product in a manner that encourages consumers to enter a display area to make one or more purchases of displayed items. There is also a need in the art for a display assembly that supports a consumer's efficient selection of a product of interest among a collection of displayed items. There is a further need in the art for a display assembly that supports a buying experience that is founded on one or more emotional motivators—the underlying reasons that drive a consumer to purchase a product. In recognition of these needs, the present invention provides a display assembly and methods that attract a consumer's attention to the display area and efficiently displays a product for convenient viewing by a consumer.

SUMMARY OF THE INVENTION

The present invention provides methods and fixtures for organizing greeting cards into particularized groupings and displaying the greeting cards on those fixtures in a manner that attracts the attention of the consumer. A fixture constructed in accordance with one or more of the inventive concepts disclosed herein can assist a consumer's navigation of displayed greeting cards and make the card purchasing process more convenient and pleasurable and less time consuming.

In support of one aspect of the invention that includes a method for marketing greeting cards, several greeting card displays can be provided in a card selling area. The card selling area generally refers to the area of a retail store in which the majority of greeting cards are displayed for sale. Each of the displays in the card selling area can be associated with a Sender's ID. The Sender's ID concept is founded on the premise that consumers typically buy greeting cards having the same "voice" each time they make a purchase. A card's voice is defined by the characteristics of the greeting card, including but not limited to, the artistic designs for the front, inside, and back of the card; the design of the card; the message copy on the front, inside, and back of the card; the style of the card; and various other aspects of the card. Cards with the same voice have a consistent collection of attributes.

For another aspect of the invention, an inventory of greeting cards can be organized by Sender's ID and displayed in the fixtures that are associated with the same Sender's ID. The fixture can include flat display panels or a tiered display panel. Each of the panels can include one or more rows of pockets on each side of the panel and can display all or a portion of the greeting cards in a full-facing manner so that all or substantially all of the front of the greeting card is visible to the consumer while the card is in the display. A Sender's ID display can be positioned above each fixture to alert consumers of the particular Sender's ID with which the fixture is associated. By organizing an inventory of cards based on consumer preferences and pointing the consumer to the location of cards with a voice that appeals to that consumer, the greeting card seller will assist the consumer in achieving a more efficient and convenient card buying experience.

For yet another aspect of the present invention, the greeting card display fixture can include a supporting structure and a tiered card display supported by the supporting structure. The tiered card display can include multiple rows of card holders, each row capable of holding copies of different greeting cards in a manner that shows all or a portion of the front of the greeting card. The greeting card display fixture can also include a display panel that is above the tiered card display.

The display panel can display content representing or identifying a Sender's ID for greeting cards on display in the tiered display panel.

For yet another aspect of the present invention, the greeting card display fixture can include multiple flat card display panels as described above. Each flat card display panel can be positioned so that it is orthogonal to at least one other display panel in the display fixture. The display fixture also can include a storage bin below one or more of the flat card display panels. Each storage bin can provide an area for storing materials associated with the display of greeting cards in the display fixture. A display panel can be positioned above one or more of the flat card display panels for identifying a Sender's ID for the greeting cards displayed in the display fixture.

For a further aspect of the present invention, a method of marketing greeting cards can include positioning several card display fixtures throughout a greeting card retail area. Each of the fixtures can be designated to hold greeting cards that are associated with a Sender's ID. The method further includes organizing the greeting cards by Sender's ID and placing the cards in the display designated to hold cards for that Sender's ID. A display panel can be positioned at or near the top of the display fixture. The display panel can provide information that helps a consumer find a display fixture that contains greeting cards associated with a particular Sender's ID.

For yet another aspect of the present invention, a method for marketing greeting cards can include positioning a greeting card display fixture along the outer perimeter of the card selling area. One or more sides of the fixture can face inward toward the card selling area while another side of the fixture can face away from the card selling area so that consumers can see that side of the fixture as they approach the card selling area. A limited selection of greeting cards can be displayed in a full-facing manner on the side of the fixture facing away from the card selling area. Captions that display the interior copy of the greeting card in a pocket can be displayed with the greeting cards in that pocket so that the consumer does not have to remove the greeting card from the pocket to view the interior copy content. By presenting fewer cards in a full-facing manner with the internal copy of each card displayed adjacent to the card, the consumer is given an opportunity to impulsively buy a greeting card without the need to enter the card selling area.

For a further aspect of the present invention, a method of marketing greeting cards can include dividing a card selling area into zones, wherein each zone is assigned a Sender's ID. Fixtures can be positioned in each zone for the display of greeting cards. Greeting cards associated with the same Sender's ID as that assigned to a particular zone can be displayed in a display fixture in that zone. One or more display panels can be positioned above the fixtures in the zone so that they are viewable by a consumer in the card selling area. Furthermore, a color can be assigned to each Sender's ID and the assigned color and content can be applied to the display panel to assist consumers in identifying which zones are associated with each Sender's ID.

BRIEF DESCRIPTION OF THE DRAWINGS

For a more complete understanding of exemplary embodiments of the present invention and the advantages thereof, reference is now made to the following description in conjunction with the accompanying drawings in which.

DETAILED DESCRIPTION OF THE EXEMPLARY EMBODIMENTS

I. Fixtures

Exemplary embodiments of the present invention will now be described in detail with reference to the figures. While the fixtures of the present invention are described in the context of an operative environment used for the display of greeting cards in the retail arena, those of ordinary skill in the art will recognize that the fixtures can be used in a similar manner for other types of products.

Figure 1:
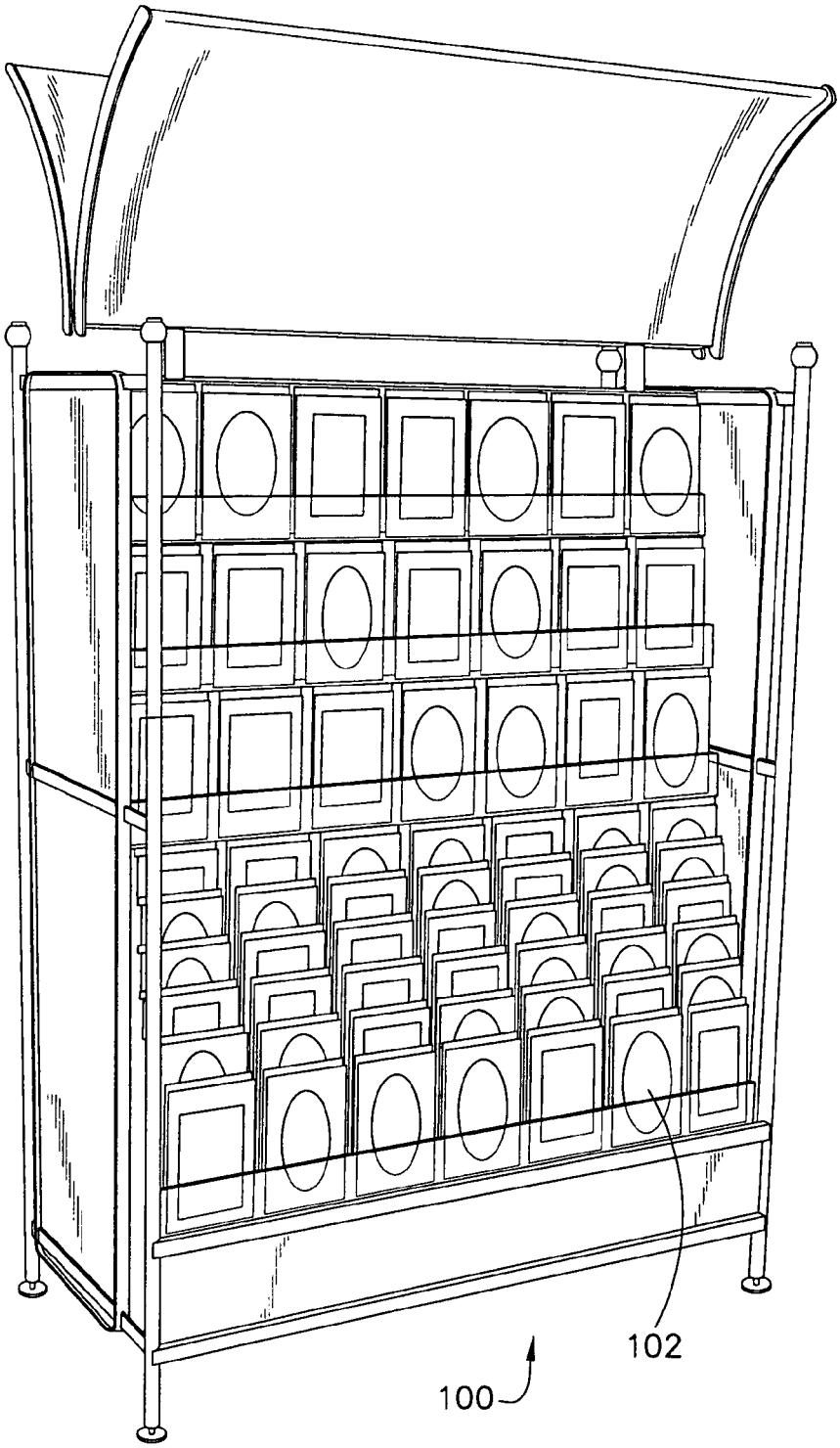
FIG. 1 illustrates a card display rack according to one exemplary embodiment of the present invention.

Referring now to FIG. 1, a detailed drawing of a display assembly 100 or rack according to an exemplary embodiment is described herein. The display assembly 100 provides a fixture for displaying multiple rows of full-faced cards in the upper fixture tier and rows of partial-faced cards in the lower fixture tier. A card display is considered full-faced when a consumer is able to see all or substantially all of the front of the card without having to remove it from a fixture of pocket. A card display is considered to be partial-faced when only the upper portion (approximately half) of the card can be seen by the consumer without having to remove the card from a fixture pocket. The display assembly 100 typically includes a storage area 102 below the lower fixture tier.

A. First Exemplary Display Assembly

1. Frame

Figure 2A:
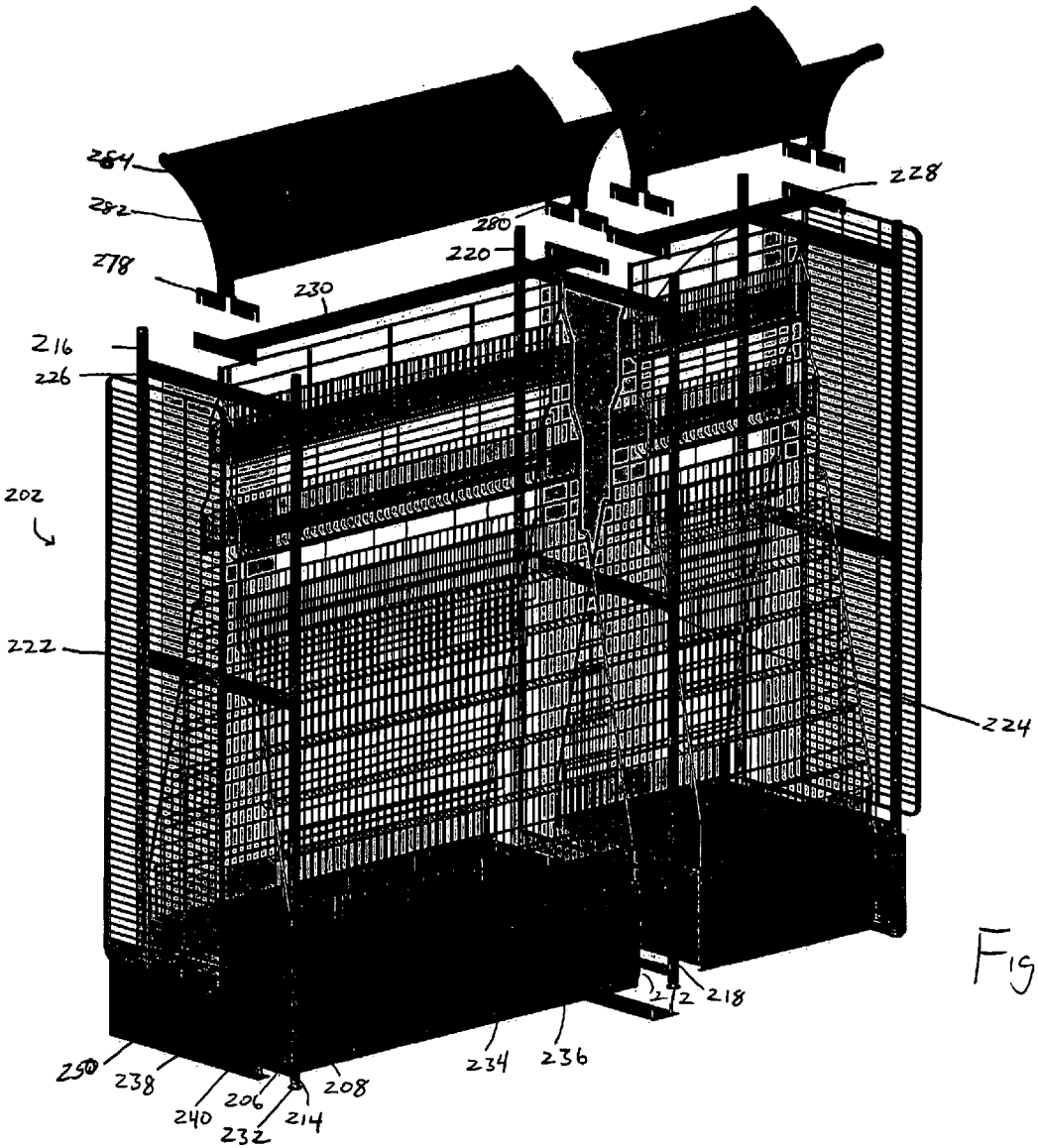
FIG. 2A illustrates a partially-exploded view of the card display rack according to an exemplary embodiment of the present invention.
Figure 2B:
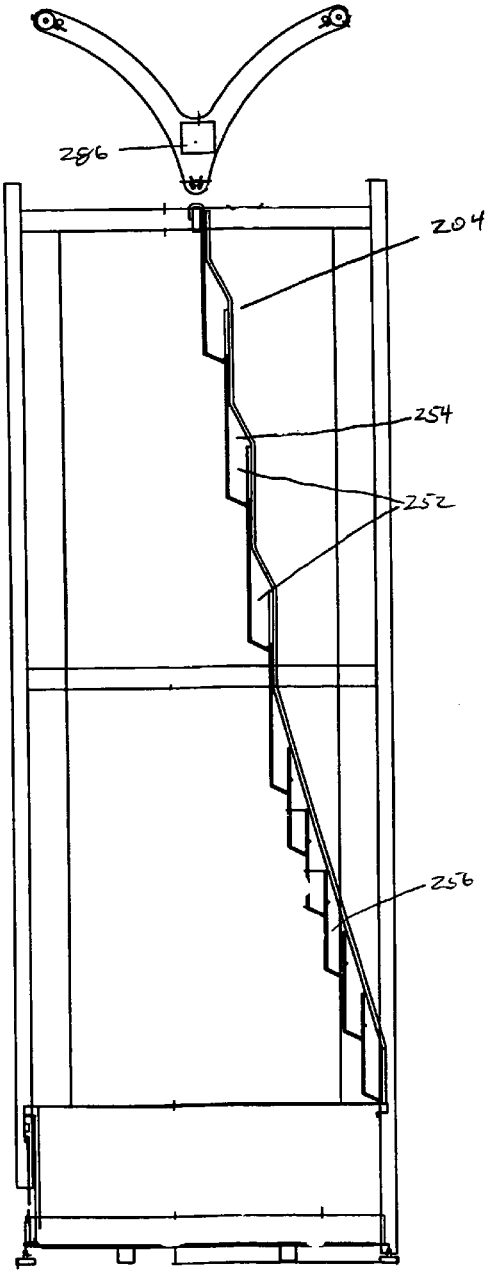
FIGS. 2B and 2C illustrate partial side views of the card display rack according to an exemplary embodiment of the present invention.
Figure 2C:
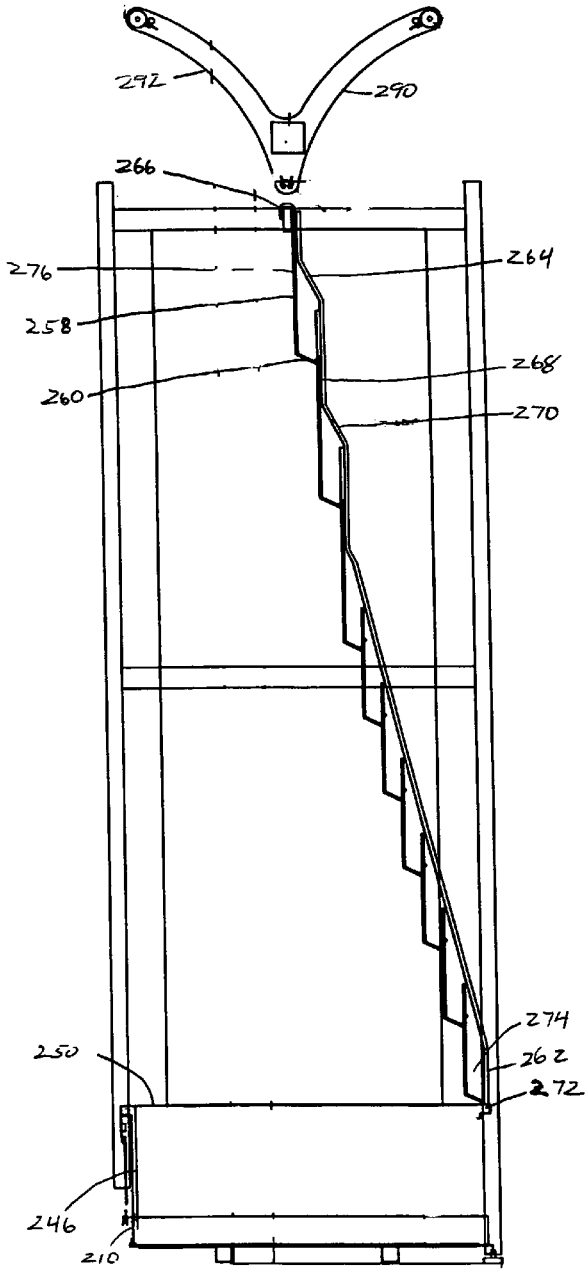

Now referring to FIGS. 2A-C, the display assembly 100 according to an exemplary embodiment of the invention is further described. The display assembly 100 includes a supporting structure 202 and a display panel 204 for greeting cards. Components of the display assembly 100 can be made from metal, wood, or hardened plastic unless otherwise stated herein. The supporting structure 202 includes a first horizontal member 206 orthogonally attached on opposing ends to second 208 and third 210 horizontal members. A fourth horizontal member 212 (not shown) is orthogonally attached to the opposing ends of the second 208 and third 210 horizontal members. A rectangular or square base is created by the assembly of the first 206, second 208, third 210, and fourth 212 horizontal members. In one exemplary embodiment, the rectangular base has a width of 49.437 inches and a depth of 24 inches (as viewed from the front of the display assembly 100). In an alternative embodiment, the rectangular base has a width of 25.437 inches and a depth of 24 inches.

A first vertical member 214 is orthogonally attached in the vertical direction to the first 206 and second 208 horizontal members and extends in the upward direction therefrom. A second vertical member 216 is orthogonally attached in the vertical direction to the first 206 and third 210 horizontal members and extends vertically upward therefrom. A third vertical member 218 is orthogonally attached to the second 208 and fourth 212 horizontal members and extends in the upward direction therefrom. A fourth vertical member 220 is orthogonally attached to the third 210 and fourth 212 horizontal members and extends in the upward direction therefrom. In one exemplary embodiment, the first 214, second 216, third 218, and fourth 220 vertical members extend to a height of seventy-three inches.

A fifth horizontal member 222, substantially parallel to the first horizontal member 206, is orthogonally attached between the first 214 and second 216 vertical members at or near the midpoint of the vertical span of the first 214 and second 216 vertical members. A sixth horizontal member 224, substantially parallel with the fourth horizontal member 212, is orthogonally attached between the third 218 and fourth 220 vertical members at a point substantially in the middle of the vertical span of the third 218 and fourth 220 vertical members. In one exemplary embodiment, the fifth 222 and sixth 224 horizontal members have a height of one and three-eighths inches and are positioned approximately thirty-four inches above ground level.

A seventh horizontal member 226, substantially parallel to the first horizontal member 206, is orthogonally attached to the first 214 and second 216 vertical members at or substantially near the endpoints of the first 214 and second 216 vertical members. An eighth horizontal member 228, substantially parallel to the fourth horizontal member 212, is orthogonally attached to the third 218 and fourth 220 vertical members at or substantially near the endpoints of the third 218 and fourth 220 vertical members and opposite the attached fourth horizontal member 212. In one exemplary embodiment, the seventh 226 and eighth 228 horizontal members have a height of one and three-eighths inches and are positioned approximately sixty-nine inches above ground level.

A ninth horizontal member 230 is orthogonally attached to and runs substantially perpendicular to and between the seventh 226 and eighth 228 horizontal members. The ninth horizontal member 230 is attached to the seventh 226 and eighth 228 horizontal members at or substantially near the midpoint of the horizontal span of the seventh 226 and eighth 228 horizontal members. The exemplary member 230 extends forty-eight and one-eighth inches between the seventh 226 and eighth 228 horizontal members. In an alternative embodiment, the exemplary member 230 extends twenty four and one-eighth inches between the seventh 226 and eighth 228 horizontal members. Feet or casters 232 may be attached to the base of the display assembly at or substantially near the intersections of the first 206 and second 208 horizontal members, the first 206 and third 210 horizontal members, the third 210 and fourth 212 horizontal members, and the second 208 and fourth 212 horizontal members.

As shown in FIG. 2A, a drawer 234 for storing cards and other products associated with the sales of greeting cards may be slidably inserted between the first 214 and third 218 vertical members and above the first 206, second 208, third 210, and fourth 212 horizontal members. The drawer 234 typically includes a front panel 236 having a handle 238 extending outward from the front panel for use in opening and closing the drawer 234. The drawer 234 also includes a left panel 240, a right panel 242 (not shown), a bottom panel 244 (not shown), and a back panel 246. The left panel 240 may be orthogonally attached to the front panel 236, the bottom panel 244, and the back panel 246. The right panel 242 may be orthogonally attached to the back panel 246, the bottom panel 244, and the front panel 236, thereby creating a drawer. Casters or roller bearing slides (not shown) may be attached to the left 240, right 242, or bottom 244 panels of the drawer 234. Guides (not shown) can be attached to the first 206 and fourth 212 horizontal members to allow the drawer 234 to be slidably inserted and opened from the display assembly 100. In one exemplary embodiment, the drawer 234 has a height of 8.187 inches, a width of 48.125 inches, and a depth of 21.183 inches. In an alternative embodiment, the drawer 234 has a height of 6.187 inches, a width of 24.125 inches, and a depth of 21.183 inches. An upper drawer panel 250 may be orthogonally attached to the first 214, second 216, third 218, and fourth 220 (not shown) vertical members. The upper drawer panel 250 is preferably positioned in a substantially horizontal plane and acts as a cover to prevent items from falling into the drawer 234.

2. Display Panel

The exemplary display assembly 100 further includes multiple pockets 252 for holding greeting cards. Some of the pockets 252 may be full-facing pockets 254 while others may be partial-facing pockets 256. The pocket structure 252 of the display assembly 100 includes multiple steeply sloping (or optionally vertical) back members 258, multiple gently sloping (or optionally horizontal) bottom members 260, and a single steeply sloping (or optionally vertical) front member 262 that extends upwardly in the vertical direction from the front edge of the upper drawer panel 250. In one exemplary embodiment, the back member 258 has a height of 6.381 inches and the front member 262 has a height of 3.451 inches. Each exemplary pocket 252 typically has a width of forty-eight and one-eighth inches and a depth of one and one-eighth inches. In an alternative embodiment, the pocket 252 has a width of twenty-four and one-eighth inches and a depth of one and one-eighth inches.

The exemplary display assembly 100 also includes divider clips 264. Each of the divider clips 264 includes means 266 for attaching to the ninth horizontal member 230, such as the hooks shown in FIG. 2C. The divider clip 264 extends downward in a series of steps that include substantially vertical steps 268 followed by downwardly angular steps 270. The divider clip 264 typically extends in a vertical direction along the back member 258 and extends downward in an angular direction to avoid making contact with the front member of each pocket 252. The divider clip 264 may be attached at its lowest point to the front portion 272 of the upper drawer panel 250 or the front member 262 of the lowest pocket 274 in the cascade of pockets 252 for the display assembly 100.

Divider clips 264 are typically positioned on each end of the pockets 252, extending downward from the ninth horizontal member 230, at or near the seventh horizontal member 226, on one side of the display assembly 100. Other divider clips 264 extend downward from the ninth horizontal member 230, at or near the eighth horizontal member 228, extending toward the upper drawer panel 250 in the display assembly 100. Additional divider clips 264 may be placed along the span of the ninth horizontal member 230 to further subdivide each row of pockets 252 (not shown). The back members 258, bottom members 260, front members 262 and divider clips 264 together form multiple compartments or half-pockets in a stepped relationship for displaying greeting cards. Each of the back members 258, except for the back member for the uppermost row of pockets 276, forms the front for a half-pocket and the back of the half-pocket. The divider clip 264 forms a common sidewall for all of the half-pockets formed through the use of the divider clip 264. If a divider clip 264 is used in a place other than the opposing ends of the ninth horizontal member 230, then the divider clip creates two series of half-pockets, one on either side of the divider clip 264. The half-pockets are opened at the top and side opposite the divider clip until a second divider clip is reached. The divider clips 264 can be moved laterally closer together or further apart in order to accommodate greeting cards of different widths and sizes in a very convenient manner.

Each of the bottom members 260 and back members 258 may be formed from a single sheet of material, such as plastic. Similarly, the front member 262 may be formed from a single sheet of a clear material, such as plastic. As seen in FIG. 1, the pockets 252 created by the back member 258, bottom member 260, front member 262 and divider clips 264 creates a series of rows for the placement of greeting cards. In one exemplary embodiment, three full-facing rows of cards are displayed beginning at or near the top of the display assembly 100. A fourth full-facing row of pockets 274 is also included on the lowest row of pockets 252. Partial-facing rows of pockets 252 are positioned below the full-facing rows of the display assembly 100.

Graphics (not shown) may be inserted into each row of pockets 252 at or substantially near the junction point between the bottom member 260 and the back member 258 and immediately in front of the bottom member 260. These graphics typically comprise a description of the types of cards that may be found on a display row or a description or statement of the contents for a particular card seated behind the graphic. For example, a graphic may describe the types of cards that are available on a row, such as birthday or anniversary or mother's birthday or wife's birthday. The graphics may be consistent along the length of the pocket 252, similar across the entire row of cards, or specific to each card placed behind the graphic. The graphics inserts are typically used for full-facing rows in the display assembly 100.

3. Concave Header Assembly

The exemplary display assembly 100 can also include a tenth 278 and an eleventh 280 horizontal member orthogonally attached to each opposing end of the ninth horizontal member 230 and extending parallel to and attached to a side of the seventh 226 and eighth 228 horizontal members, respectively. A pair of header graphic panels 282, 284 may be attached to the tenth 278 and eleventh 280 horizontal members. The panels 282, 284 extend substantially from the center point of the seventh 226 and eighth 228 horizontal members and upward towards the first 214 and third 218 vertical members (on one side) and the second 216 and fourth 220 vertical members (on the other side). In one exemplary embodiment, the header graphic panels 282, 284 are substantially concave, creating a V-shaped assembly. In one exemplary embodiment, the header graphic panels 282, 284 have a height of 11.312 inches, extend to a height of 84.312 inches above ground level, have a width of 48.125 inches, and have top edges that extend 10 inches out from the ninth horizontal member 230. In an alternative embodiment, the header graphics panels 282, 284 have a width of twenty-four and one-eighth inches. The concave header graphic panel 283 can also include a ballast 286 and lighting assembly 288 (not shown) at or substantially near the intersection of the V-shaped concave header graphics panels 282, 284.

The lighting assembly 288 is capable of providing light on either side of each of the concave header graphics panels 282, 284. Each concave portion of the header graphics panel 290, 292 can also include a receptacle 294 (not shown) at the top and the bottom sides of the header graphics panel 282, 284 so that a graphic 296 (not shown) can be slidably inserted, or snapped, into each graphics panel 282, 284. Each graphic 296 in the concave header graphics panel 282, 284 can include a Sender's ID (or pictures and graphics) that are useful for generating emotions in consumers. The Sender's IDs are associated with the occasion for which cards are displayed in the display assembly 100. In one exemplary embodiment, based on a detailed analysis of card-buying consumers, four distinct groups, or Sender's IDs, are identified for the preferred embodiment of the inventive display concept: classic, contemporary, funny, and sweet & simple.

The Sender's ID concept is founded on the premise that consumers typically buy greeting cards having the same "voice" each time they make a purchase, if cards having the voice corresponding to the consumer are displayed by one or more card fixtures. A card's voice is defined by the characteristics of the greeting card, including but not limited to, the artistic designs for the front, inside, and back of the card; the design of the card; the message copy on the front, inside, and back of the card; the style of the card; and various other aspects of the card. Cards with the same voice have a consistent collection of attributes. By organizing an inventory of cards based on consumer preferences and pointing the consumer to the location of cards with a voice that appeals to that consumer, the greeting card seller will assist the consumer in achieving a more efficient and convenient card buying experience.

Conventional greeting card departments have required a consumer to navigate the fixtures positioned throughout the entire department to locate cards in each of the representative card categories (i.e. Birthday, Wedding, Anniversary). The application of Sender's ID concept to a card layout results in the presentation of cards having a similar voice for all of the primary card categories in only a portion of the department, where one or more fixtures organized by particular Sender's ID is located. A consumer may view a single department section, a Sender's ID zone, to review greeting cards covering most or all primary card categories, thereby reducing the amount of cards and time a consumer is required to spend in the greeting card department. The consumer enjoys an efficient and convenient shopping experience because the collection of cards is organized in a manner that is consistent with consumer preferences and displayed with visual cues that readily identify the card collection locations associated with different consumer preferences. Those of ordinary skill in the art will recognize that, while the exemplary embodiment describes a department having four Sender's ID zones, greater or fewer number of Sender's ID zones could be presented in a greeting card department based on a determination of the number of groups of card consumers that a manufacturer or retailer wishes to target.

Figure 2D:
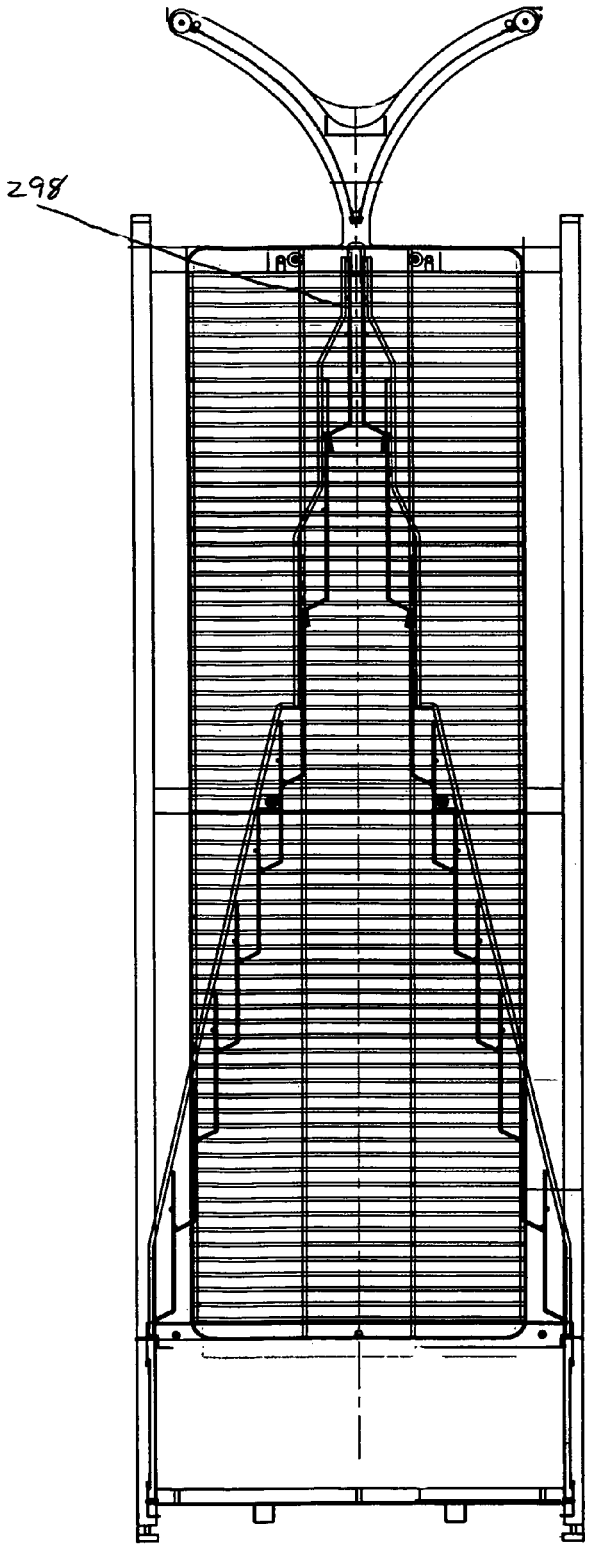
FIG. 2D illustrates a side view of the card display rack according to an exemplary embodiment of the present invention.

FIG. 2D provides a detailed drawing of an exemplary display assembly 100 having cascading rows extending down the front and back of the assembly. Referring now to FIG. 2D, a mirrored set of divider clips and cascading rows of full and partially-facing pockets 298 extend from the ninth horizontal member 230, downward and toward the back of the upper drawer panel 250 and the third horizontal member 210. Two cascading row of pockets are provided, one for each of the front and back sides of the display assembly 100. Those of ordinary skill in the art will recognize that the type and arrangement of full-facing and partial-facing pockets that create the rows for the display assembly, can be easily adjusted and modified to suit the user's needs. The mounting and partitioning of the full-facing and partial-facing pockets and rows are not limited to identical arrangements for the front and back side of the display assembly 100.

Figure 3A:
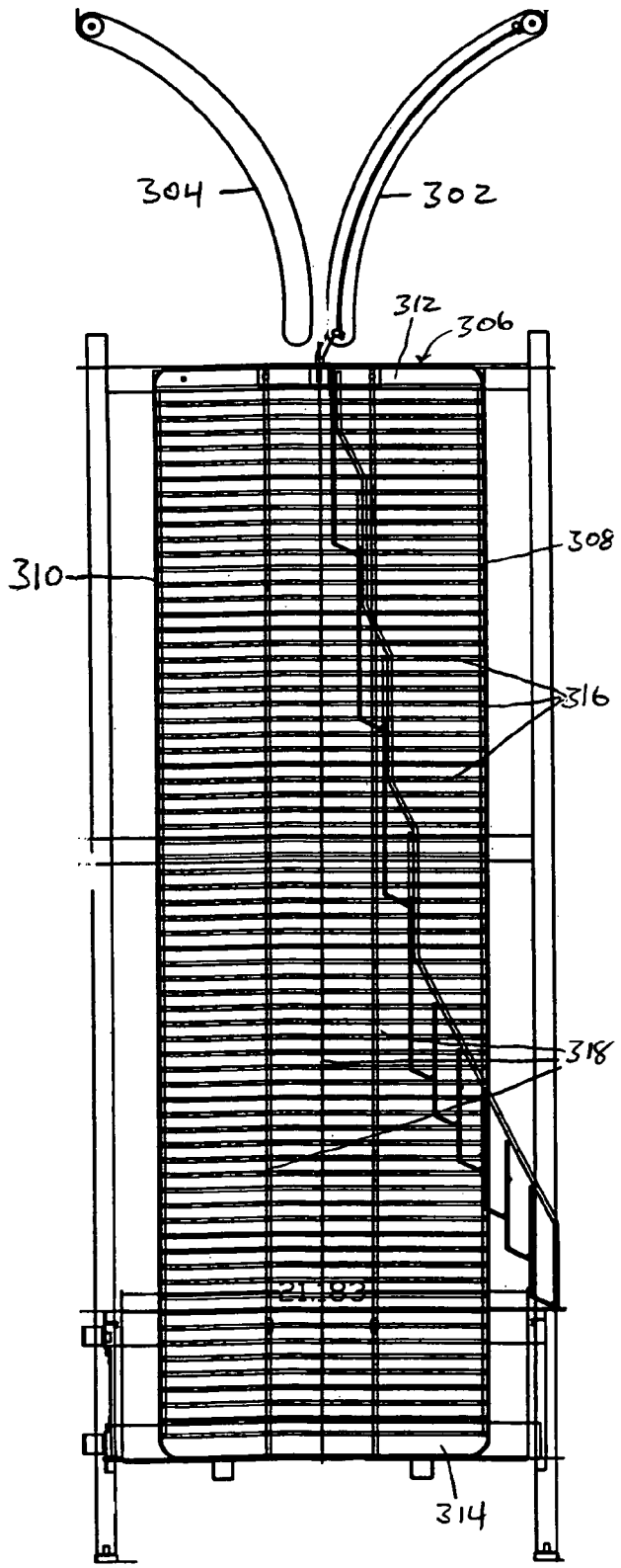
FIG. 3A illustrates a side view of a card display rack according to another exemplary embodiment of the present invention.

FIG. 3A provides a detailed drawing of a second exemplary embodiment of the concave header graphics panel. As provided in FIG. 3A, the concave header graphics panel assembly maybe split into two separate pieces 302, 304, each attached to the tenth horizontal member 278 and to the eleventh horizontal member 280 (not shown). In one exemplary embodiment, the header graphic panels 302, 304 have a height of 17.207 inches, extend to a height of 88.207 inches above ground level, have a width of 48.125 inches, and have top edges that extend 12.1755 inches out from the ninth horizontal member 230. In an alternative embodiment, the header graphics panels 302, 304 have a width of 24.125 inches.

In FIG. 3A, the display assembly 100 may also include a screen assembly 306 that functions as an end cap for each side of the display assembly 100. The screen assembly 306 typically includes first 308 and second 310 vertical members orthogonally attached on one end to a first upper horizontal member 312 and orthogonally attached on the opposing end to a second horizontal member 314. The first 308 and second 310 vertical members and the first 312 and second 314 horizontal members make up the frame of the screen assembly 306. In one exemplary embodiment, the frame of the screen assembly 306 has a height of 59.152 inches and a width of 18 inches. Multiple horizontal 316 and vertical 318 members may be attached to the frame so that the vertical members 318 are orthogonally attached to the first 312 and second 314 horizontal members and the horizontal members 316 are orthogonally attached to the first 308 and second 310 vertical members to create a blinds-type effect.

4. End Cap Assembly

The screen assembly 306 may be attached to the top of one end of the display assembly 100 at the seventh horizontal member 226 and at the bottom to the side of the upper drawer panel 250. An opposing screen assembly 306 (not shown) for the other side of the display assembly 100 may be attached at the top to the eighth horizontal member 228 and at the bottom to the upper drawer panel 250. A plastic paper or metallic mesh-type screen 320 (not shown) may be attached between the screen assembly 306 and the display assembly 100. The screen 320 has a width and length substantially equal to the width and length of the screen assembly 306, thereby creating a darkening effect when viewing the display assembly 100 from the side and through the screen assembly 306. In one exemplary embodiment, the screen 320 has a width of 18 inches and a height of 59.152 inches.

Figure 3B:
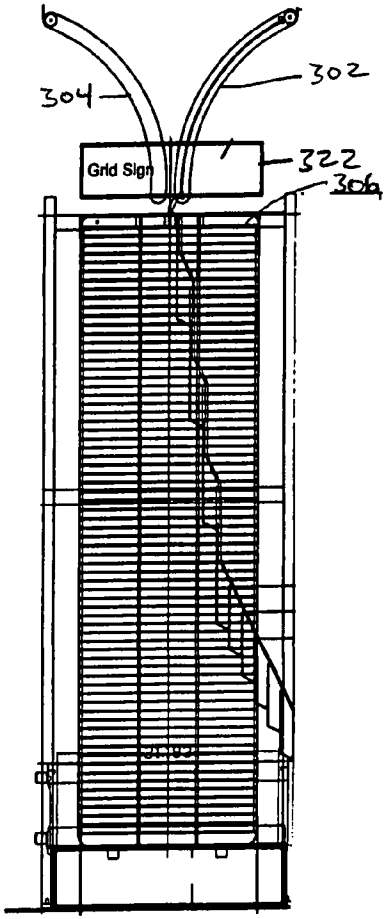
FIGS. 3B and 3C illustrate side and perspective views of card display racks according to a further exemplary embodiment of the present invention.

FIG. 3B provides a detailed drawing of the exemplary display assembly 100. Now turning to FIG. 3B, the display assembly 100 may also include first 322 and second 324 (not shown) graphics panels that are substantially parallel to the screen assembly 306 and face outward from the side of the display assembly. Each of the graphics panels 322, 324 may be attached to the concave header graphics panels 282, 284 or, in the alternative, may be attached to the seventh horizontal member 226 (not shown) or eighth horizontal member 228 (not shown), respectively. The first and second graphics panels 322, 324 typically include a substantially rectangular panel having a width substantially equal to the width of the screen assembly and a height substantially less than the height of the concave header graphics panels 282, 284. In one exemplary embodiment, the graphics panels 322, 324 have a width of eighteen inches. The first 322 and second 324 graphics panels may include a Sender's ID or description of the occasion or types of cards that may be found in the display assembly (i.e. Birthday, Anniversary, Wedding, etc.).

5. Lighting and Other Header Assemblies

Figure 4:
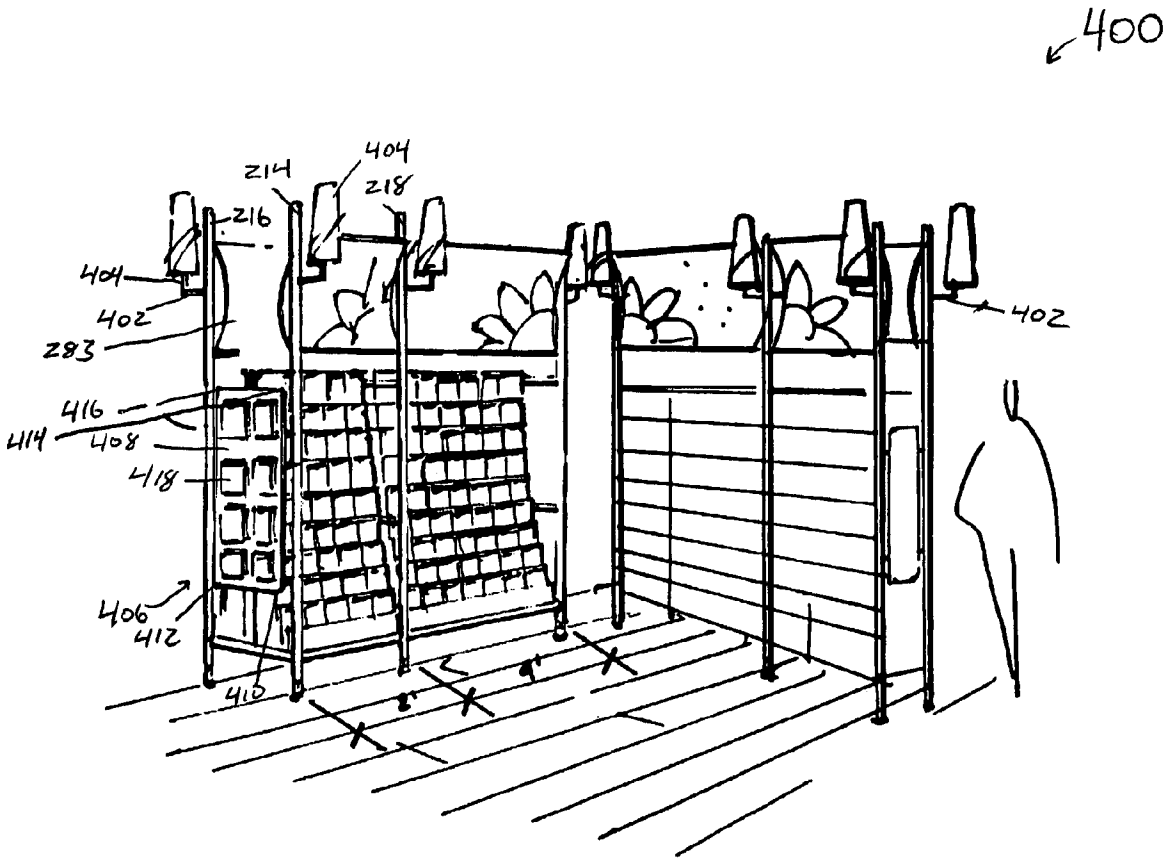
FIG. 4 illustrates a lighting and end cap configuration for a card display rack according to an exemplary embodiment of the present invention.

FIG. 4 provides a detailed drawing of an exemplary display assembly 400 having a second exemplary lighting system. Now referring to FIG. 4, light fixtures may be attached to the display assembly 400 at or near the concave graphics header panel 282, 284. As shown in FIG. 4, a light support member 402 may be orthogonally attached at one end and extend outwardly and in a substantially horizontal direction from the first 214 and third 218 vertical members. In the alternative, a light support member 402 may be attached on the opposing side of the display panel from the second 216 and fourth 220 (not shown) vertical members. A light 404 may be attached along and substantially near the opposing end of the light support member 402, thereby adding a light source to the concave header graphics panels 282, 284.

Although the exemplary embodiment of FIG. 4 describes light support members 402 and lights 404 on each of the first 214, second 216, third 218, and fourth 220 vertical members, a light support member 402 and light 404 could be attached to only one of the vertical members on each side of the display assembly 400 or may be attached to the vertical members in a random manner. For example, a light support member 402 and light 404 may be attached to the first vertical member 214 and the second vertical member 216 on the opposing sides of the display assembly 400.

The display assembly, as further described in FIG. 4, also includes an alternative embodiment of an end cap 406. The alternative end cap assembly 406 can include a card display panel 408 having a substantially rectangular shape. The card display panel 408 is attached at bottom corners 410, 412 to the first 214 and second 216 vertical members and at top corners 414, 416 to the first 214 and second 216 vertical members. In the alternative, the card display panel 408 is mounted on the opposing side of the display assembly 400 to the third 218 and fourth 220 (not shown) vertical members and to the third 218 and fourth 220 vertical members. The card display panel 408 typically includes two columns of full-facing card displays 418. Each column of full-facing card displays 418 includes multiple pockets 418. Each of the pockets 418 has a front member 420 (not shown), bottom member 422 (not shown), a left-side member 424 (not shown) and a right-side member 426 (not shown). The front 418, bottom 420, left 422, and right-side 424 members are typically made of a clear material, such as plastic. In one exemplary embodiment, the card display panel 408 includes two columns of four rows of full-facing card pockets 418 so that eight cards may be held within the card display panel 408.

Figure 5:
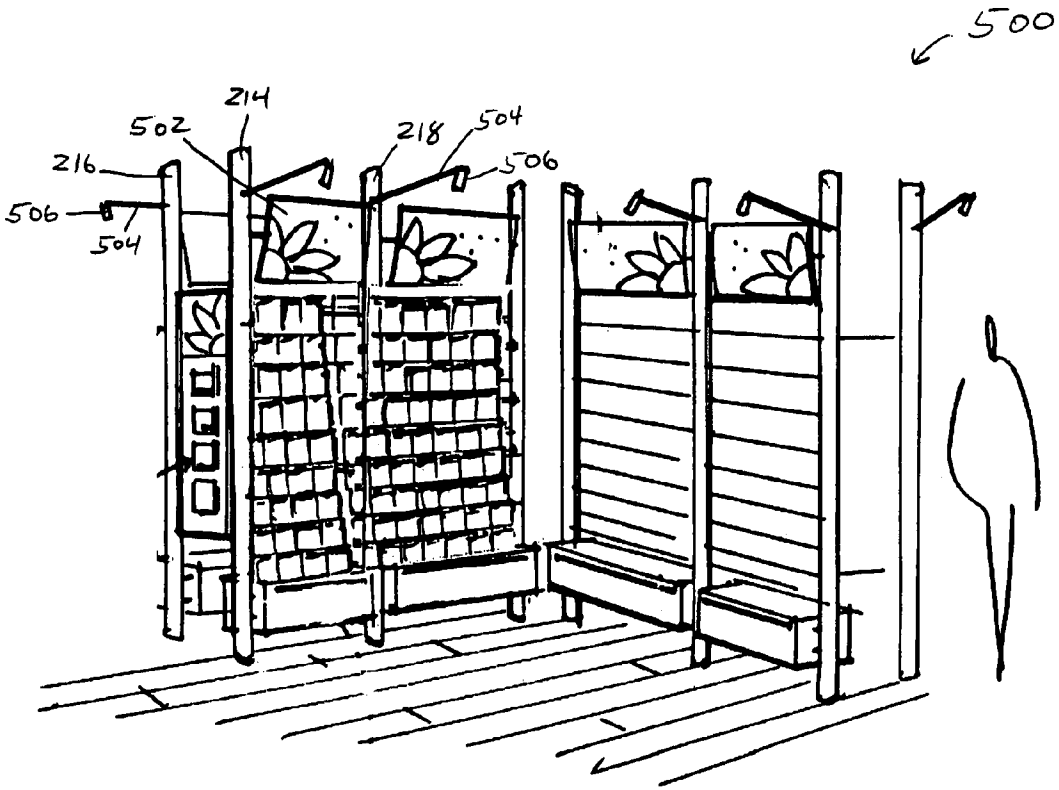
FIG. 5 illustrates a lighting and header configuration for a card display rack according to an exemplary embodiment of the present invention.

A detailed drawing of an additional exemplary embodiment of the display assembly 500 is provided in FIG. 5. Now referring to FIG. 5, the bottom of a convex graphics display panel 502 is orthogonally attached to the ninth horizontal member 230 (not shown) and the top of the panel 502 is attached to an extended portion of the first vertical member 214 and the third vertical member 218, thereby creating an outward-facing graphics display. As with the concave header graphics panel, the convex header graphics panel 502 typically includes one or more receptacles (not shown) at the top and bottom of the convex header graphics panel 502 to permit the insertion of graphic 503 into the convex header graphics panel 502. The display assembly 500 also includes an exemplary lighting system. One or more light support members 504 are orthogonally attached to the vertical members 214, 216, 218, 220 of the display assembly 500. For example, the light support members 504 may be orthogonally attached to the first 214 and third 218 vertical members on one side of the display, assembly 500 and the second 216 and fourth 220 (not shown) vertical members on the opposing side of the display assembly 500. At or substantially near the opposing endpoint of the light support member 504, a light 506 is provided in a downward facing manner to provide additional light onto the display assembly 500.

Figure 6:
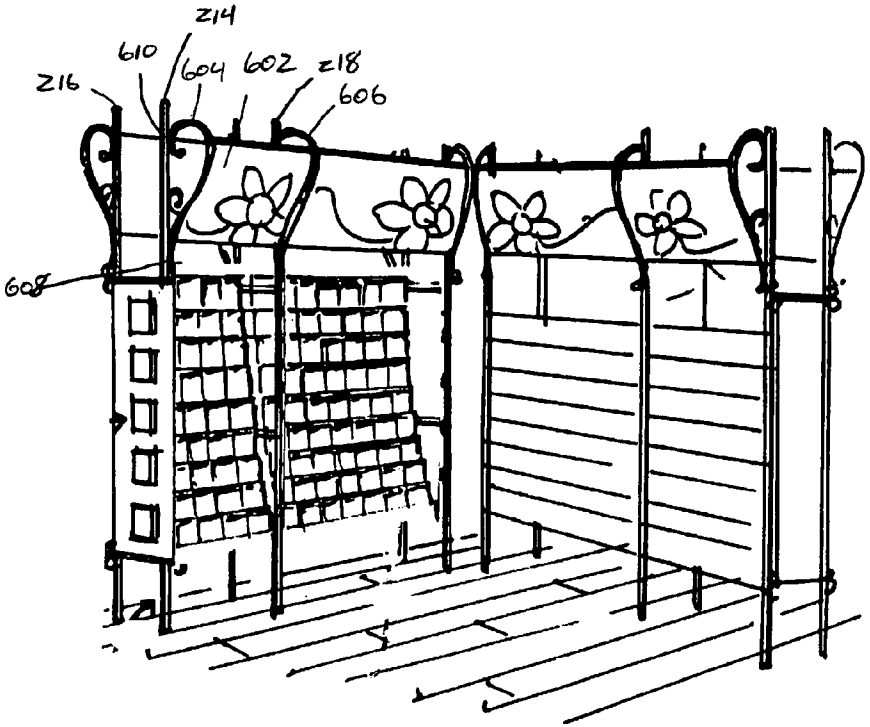
FIG. 6 illustrates another header configuration for a card display rack according to an exemplary embodiment of the present invention.

A detailed drawing of an alternative exemplary embodiment of the display assembly is provided in FIG. 6. Referring now to FIG. 6, the exemplary display assembly includes a convex header graphics panel 602 attached orthogonally to multiple scroll detail members 604, 606. Each scroll detail member 604, 606 can be attached on a bottom end 608 to a first 214 or third 218 vertical member and extend upward to a point where it is attached at the top end 610 of the scroll detail member 604, 606 to an extended portion of the first 214 or third 218 vertical member. The convex header graphic panel 602 may then be orthogonally attached between the first scroll detail member 604 and the second scroll detail member 606.

B. Second Exemplary Display Assembly

1. Frame Assembly

Figure 3C:
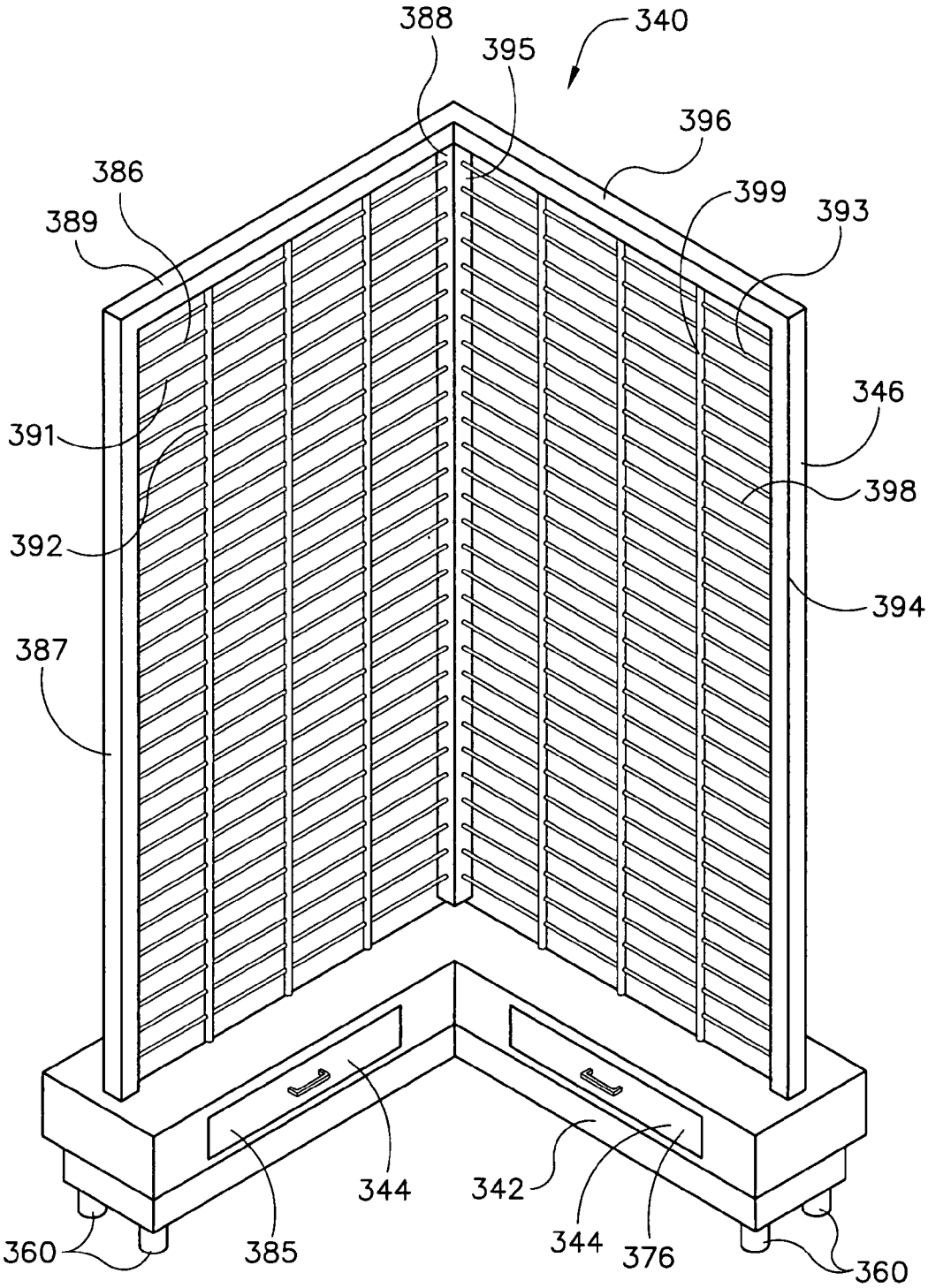

Referring now to FIG. 3C, a second exemplary display assembly 340 shall be described. The second exemplary display assembly 340 is generally L-shaped and is typically configured to promote the Quickshop concept. Quickshop provides a curated selection of cards having a significantly reduced selection in order to reduce the amount of time a consumer spends to view cards on the fixture. Furthermore, with Quickshop, the displayed cards cover multiple occasions (i.e. Birthday, Anniversary, Wedding, Thank you, etc.) in order to provide a broader range of choices to the busy consumer and generate cross-occasion sales. Quickshop cards are laid out in full-faced rows with footers listing the text inside the card to allow the consumer to more quickly scan the cards and make a quick purchase.

The second exemplary display assembly 340 typically includes a frame 342 (not shown), two storage cabinets 344, and two display rack assemblies 346. The frame 342 for the second exemplary display assembly 340 includes a first horizontal member 348 (not shown) orthogonally attached at one end to a first end of a second horizontal member 350 (not shown). The end of the second horizontal member 350 is orthogonally attached to an end of a third horizontal member 352 (not shown), the third horizontal member 352 positioned substantially parallel to the first horizontal member. An end of a fourth horizontal member 354 (not shown) is orthogonally attached to an end of the third horizontal member 352. The fourth 354 and second 350 horizontal members are positioned substantially parallel to one another.

An end of a fifth horizontal member 356 (not shown) is orthogonally attached to an end of the fourth horizontal member 354. The fifth 356, third 352, and first 348 horizontal members are positioned substantially parallel to one another. An end of a sixth horizontal member 358 is orthogonally attached to an end of the fifth horizontal member 356. The sixth horizontal member 358 is orthogonally attached to the first horizontal member 348. The assembly of the first through sixth horizontal members creates a horizontal, substantially L-shaped, frame. Feet, casters, or wheels 360 (not shown) may be orthogonally attached to the bottom side of the frame 342 to elevate the frame off of the ground.

2. Storage Cabinet Assembly

A first storage cabinet 362 (not shown) of the exemplary display assembly 342, operative to store cards and other products associated with the sale of greeting cards, includes a bottom panel 364 (not shown). The bottom panel 364 is positioned in the horizontal plane, adjacent to the top side of the first 348, second 350, and sixth 358 horizontal members of the frame and lying on the top side of a portion of the fifth horizontal member 356. The bottom panel 364 includes a front 365 (not shown), back 366 (not shown), left-side 367 (not shown) and right-side 368 (not shown) edge. A bottom edge of a right-side panel 370 (not shown) can be orthogonally attached to the right-side 368 of the bottom panel 364 along a line substantially equal to the outer side of the first horizontal member 348 and extends upwardly therefrom. A bottom edge of a left-side panel 372 can be orthogonally attached to the left side 367 of the bottom panel 364 along a line substantially equal to the outer side of the fifth horizontal member 356 and extends upwardly therefrom. A back panel 374 (not shown) is orthogonally attached to the bottom 364, left-side 372, and right-side 368 panels and extends upward from the bottom panel 364 along a line substantially equal to an exterior side of the second horizontal member 350. A horizontal top panel 375 (not shown) is orthogonally attached to the right-side 368, left-side 372, and back 374 panels and is substantially parallel to the bottom panel 364. A drawer 376 may be slidably inserted into the space created by the bottom 364, top 375, left-side 372 and right-side 368 panels. The drawer 376 is substantially similar to the drawer described in FIG. 2A and will not be further described herein.

A second storage cabinet 341 of the exemplary display assembly 342 includes a bottom panel 377 (not shown) lying in the horizontal plane on the top side of the third 352, fourth 354, and fifth 356 horizontal members of the frame. The bottom panel 377 includes a front 378 (not shown), back 379 (not shown), left-side 380 (not shown) and right-side 381 (not shown) edge. A bottom edge of a right-side panel 382 (not shown) can be orthogonally attached to the right-side 381 of the bottom panel 377 along a line substantially equal to the line of contact between the first storage cabinet 362 and the bottom panel 377 and extends upwardly therefrom. A bottom edge of a left-side panel 343 (not shown) can be orthogonally attached to the left side 380 of the bottom panel 377 along a line substantially equal to the outer side of the fourth horizontal member 354 and extends upwardly therefrom. A back panel 383 is orthogonally attached to the bottom 377, left-side 343 and right-side 382 panels and extends upward from the bottom panel 377 along a line substantially equal to the outer side of the third horizontal member 352. A horizontal top panel 384 is orthogonally attached along its bottom side to the right-side 382, left-side 343, and back 383 panels and is substantially parallel to the bottom panel. A drawer 385 may be slidably inserted into the space created by the bottom 377, top 384, left-side 343 and right-side 382 panels. The drawer 385 is substantially similar to the drawer as described in FIG. 2A and will not be further described herein.

3. Display Rack Assembly

A first display rack 386 for the second exemplary display assembly 340 of FIG. 3C typically includes first 387 and second 388 vertical members orthogonally attached on one end to a first upper horizontal member 389 and orthogonally attached on the opposing end to a second horizontal member 390 (not shown). The first 387 and second 388 vertical members and the first 389 and second 390 horizontal members make up the frame of the display rack. Multiple horizontal 391 and vertical 392 members (not shown) may be attached to the frame so that the vertical members 392 are orthogonally attached to the first 389 and second 390 horizontal members and the horizontal members 391 are orthogonally attached to the first 387 and second 388 vertical members of the second exemplary display assembly 340. The first display rack 386 may be attached to the second exemplary display assembly 340 by orthogonally attaching the bottom side of one end of the second horizontal member 390 to a top side of the first storage cabinet 362 (not shown) and the bottom side of the other end of the second horizontal member 390 to a top side of the first storage cabinet 362 (not shown).

A second display rack 393 for the exemplary display assembly 340 of FIG. 3C typically includes a first 394 and second 395 vertical member orthogonally attached on one end to a first upper horizontal member 396 and orthogonally attached on the opposing end to a second horizontal member 397 (not shown). The first 394 and second 395 vertical members and the first 396 and second 397 horizontal members make up the frame of the display rack 393. Multiple horizontal 398 and vertical 399 members (not shown) may be attached to the frame of the second display rack 393 so that the vertical members 399 are orthogonally attached to the first 396 and second 397 horizontal members (not shown) and the horizontal members 398 are orthogonally attached to the first 394 and second 395 vertical members of the exemplary display assembly 340. The second display rack 393 may be attached to the second exemplary display assembly 340 by orthogonally attaching the bottom side of one end of the second horizontal member 397 (not shown) to a top side of the second storage cabinet 341 and the bottom side of the other end of the second horizontal member 397 to a top side of the second storage cabinet 341.

Both the front side and the back side of the first and second display racks 386, 393 may also include multiple pockets (not shown), each extending horizontally, substantially parallel to the second horizontal members 390, 397 of the first and second display racks. Each pocket may be orthogonally attached at a first end to the first: vertical member 387, 394 of either the first or second display rack and orthogonally attached at a second end to the second vertical member 388, 395 of either the first or second display rack. The pockets on the second exemplary display assembly 340 are vertically spaced apart so that the top portion of cards placed into a pocket will not cover the bottom portion of the cards in the pocket immediately above, thereby providing a full-facing card display.

The second exemplary display assembly may also include one or more header graphic holders (not shown). The header graphic holder typically has a substantially rectangular shape. The header graphic holder is generally attached along, substantially parallel to, and on both the front and back side of the upper horizontal member 389, 396 of the first and second display racks. The header graphic holder can include top and bottom connecters (not shown) so that a graphic (not shown) may be slidably inserted, or snapped, into the header graphic holder. The graphic, inserted into the header graphic holder, is typically made of acrylic, card stock, or plastic. In one exemplary embodiment, the graphic for the second exemplary display assembly displays the "Quickshop" name, signaling to consumers that the second exemplary display assembly 340 is used to support the Quickshop concept.

C. Third Exemplary Display Assembly

Figure 7:
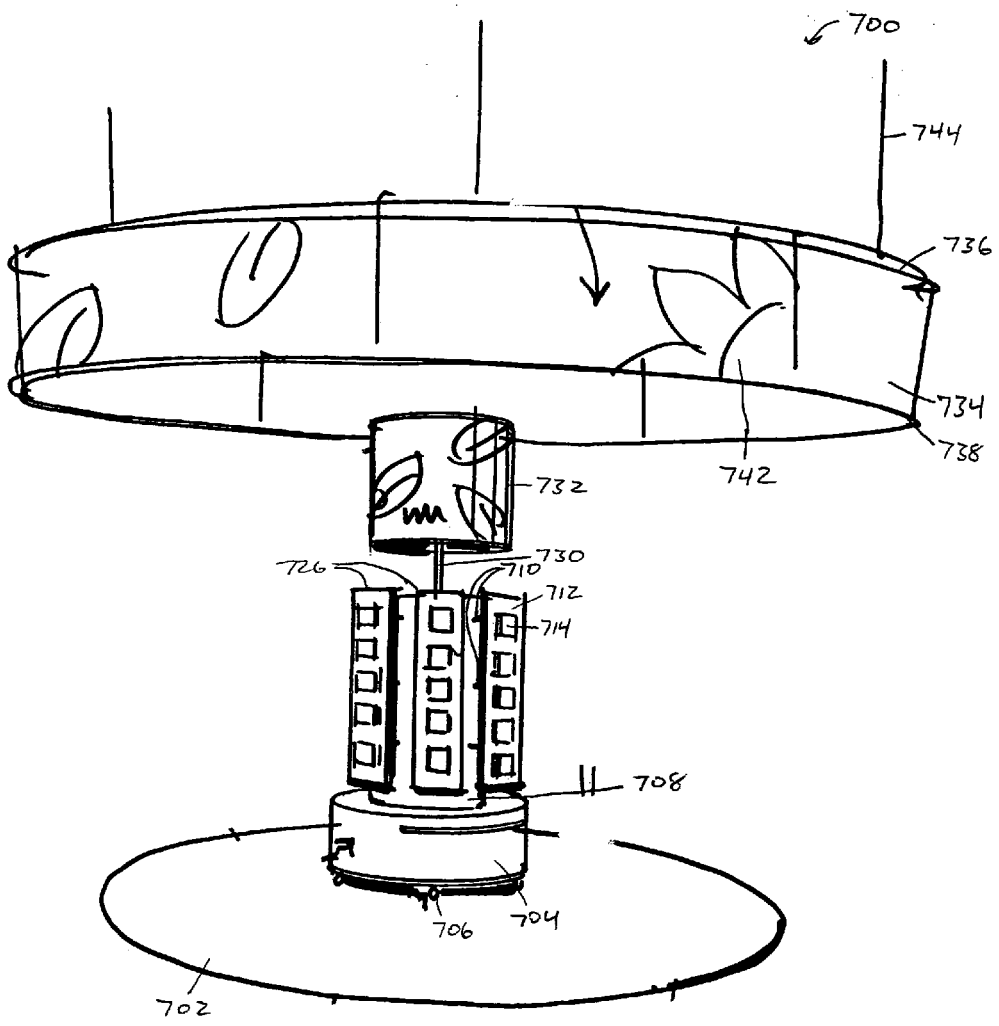
FIG. 7 illustrates a wheel-based configuration for a card display area according to another exemplary embodiment of the present invention.

A detailed drawing of an alternative exemplary embodiment of a display assembly 700 is provided in FIG. 7. Now referring to FIG. 7, the exemplary display assembly 700 includes a substantially circular accent floor 702 acting as the base for the display assembly 700. The circular accent floor 702 can be made of materials known to those of ordinary skill in the art. In one exemplary embodiment, the accent floor 702 is made of wood and is typically different from the flooring of the remainder of the retail area outside of the accent floor 702. The display assembly 700 also includes a cylindrical base 704 made of wood, plastic or metal. The cylindrical base 704 may rest on the accent floor 702 or may be raised from the accent floor 702 through the use of feet or casters 706 orthogonally attached to the bottom side of the cylindrical base 704 and extending downward therefrom to raise the cylindrical base 704 off the floor 702. The display assembly 700 also includes a cylindrical centerpiece 708 positioned, substantially in the center of the cylindrical base 706 and extending upward therefrom. In one exemplary embodiment, the diameter of the cylindrical base 706 is greater than the diameter for cylindrical centerpiece 708.

Several horizontal members 710 can extend outward in an orthogonal manner along the horizontal plane from the cylindrical centerpiece 708. The horizontal members 710 are positioned to create several columns of horizontal members 710, running along the vertical axis on the outer circumference of the cylindrical centerpiece 708. In one exemplary embodiment, four or more columns of horizontal members 710 are evenly spaced about the circumference of the cylindrical centerpiece 708. A card panel 712 having a substantially rectangular shape can be orthogonally attached to the outwardly exposed endpoints of the column of horizontal members 710 (not shown). The card panel 712 typically has a height substantially greater than its width. The card panel 712 typically includes a single column having multiple rows of full-facing pockets 714 for receiving greeting cards.

Each full-facing pocket 714 can include a front member 716 (not shown), a bottom member 718 (not shown), a left-side member 720 (not shown), and a right-side member 722 (not shown). The left 720 and right-side 722 members and the bottom member 718 for each full-facing pocket 714 can be orthogonally attached to the card panel 712. Each of the left 720 and right-side 722 members may include one or more tabs 724 (not shown) that may be used for attaching the pocket 714 to the card panel 712 so that the full-facing pockets may be moved up and down the card panel to suit the user's needs. In another exemplary embodiment, the full-facing pockets 714 may be attached to the card panel 712 using bolts, nuts, screws, adhesive or other methods known to those of ordinary skill in the art. The full-facing pockets 714 are typically positioned in a column format so that the full face of each greeting card may be viewed without obscuring the view of the greeting card in the pocket immediately above it.

Additional card panels 726 may be placed along additional columns of horizontal members 710 and attached thereto. Each pocket in the card panel 712 may also include a graphic 728 (not shown) that can be inserted against and at the point where the front member 716 is orthogonally attached to the bottom member 718. The graphic 728 typically provides the consumer information about the type of card or the occasion that the card is typically bought for (i.e. Birthday, Anniversary, etc.). In the alternative, this graphic 728 can provide a copy of the text inside the greeting card displayed in the card pocket. The display assembly of FIG. 7 also includes a first vertical member 730 orthogonally attached to the top portion of the cylindrical centerpiece 708 at one end and extending upward in the vertical direction therefrom. A cylindrical graphic 732 can be attached to the uppermost portion of the first vertical member 730. In one exemplary embodiment, the cylindrical graphic 732 is translucent so that light may shine through and enhance the graphic in the cylindrical graphic 732. The cylindrical graphic 732 can include a lamp or lighting means 734 (not shown) to project light through the graphic in the cylindrical graphic 732. The cylindrical graphic 732 typically has a radius greater than the first vertical member 730 and substantially equal to the radius of the cylindrical centerpiece 708. The cylindrical graphic 732 can provide information such as the Sender's ID, for the cards that are held in the display assembly 700, information about the occasion which the cards displayed by the display assembly 700, or pictures and graphics that are intended to generate an emotional response from the consumer.

The display assembly 700 may also include a cylindrical overhead marquee 734. The cylindrical overhead marquee 734 typically has a radius substantially equal to the radius of the accent floor 702 and substantially greater than the radius of the cylindrical centerpiece 708 and the cylindrical base 704. The cylindrical overhead marquee 734 typically includes a top circular member 736 and a bottom circular member 738, each having receptacles 740 (not shown) that allow graphics 742 to be slidably inserted, or snapped, into and between the top circular member 736 and bottom circular member 738. The graphics 742 inserted into the cylindrical overhead marquee 734 are generally outward facing, so that they may be seen from a great distance away from the display assembly 700. The graphics 742 are intended to attract the consumer into the card retail area.

The cylindrical overhead marquee 734 can hold multiple graphics 742, each occupying a certain portion of the circumference of the cylindrical overhead marquee 734. The graphics 742 for the cylindrical overhead marquee 734 are typically made of card or plastic stock and provide graphics or pictures that will inform people that greeting cards are available under the cylindrical overhead marquee 734. The cylindrical overhead marquee 734 is typically suspended from a ceiling (not shown) by one or more cables 744 attached to the top circular member 736 and a ceiling, roof top, or other point of attachment that resides above the display assembly 700.

E. Fourth Exemplary Display Assembly

Figure 8:
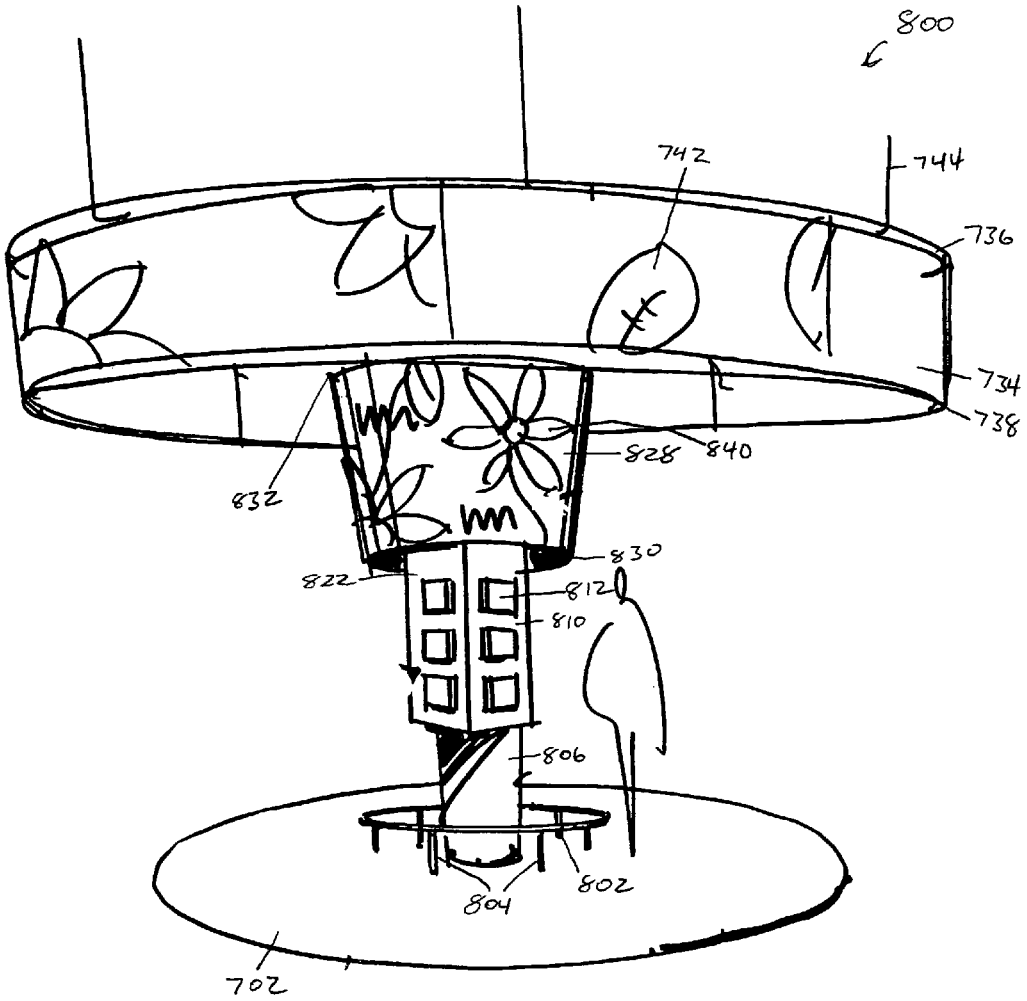
FIG. 8 illustrates a bulletin board configuration for a card display area according to another exemplary embodiment of the present invention.

Detailed drawings of another exemplary embodiment 800 of the display assembly are provided in FIG. 8. Now referring to FIG. 8, the exemplary display assembly 800 includes an accent floor 702 substantially similar to the one described in FIG. 7. The display assembly 800 also includes a first circular member 802 orthogonally attached to several vertical members 804. Each vertical member 804 is generally attached, or is placed, on one end to the ground and extends upwardly therefrom in a vertical direction to the point where it is attached to the circular member 802, thereby creating a circular foot rail. The display assembly 800 also includes a cylindrical base 806 centered inside the circular foot rail. The cylindrical base 806 can be attached to, or rest upon, the accent floor 702 and rises vertically therefrom. The display assembly 800 includes multiple horizontal members 808 (not shown) orthogonally attached to the cylindrical base 806 and extending horizontally from the circumference of the cylindrical base.

A first panel 810, having a substantially rectangular shape and a vertical side substantially greater than its horizontal side, is orthogonally attached to the opposing end of a column of horizontal members 808 mounted to the cylindrical base 806. This rectangular panel includes multiple greeting card pockets 812 displayed in a substantially vertical column along the central axis of the first panel 810. Each pocket 812 includes a left-side member 814 (not shown), a right-side member 816 (not shown), a front member 818 (not shown), and a bottom member 820 (not shown). The front member 818 is typically made of a clear material, such as plastic.

The first panel 810 may be attached at its upper and lower corners on a vertical side to the upper and lower corners on a vertical side of a second rectangular panel 822. The second rectangular panel 822 may be orthogonally attached at upper and lower corners of an opposing vertical side to the upper and lower corners of a vertical side for a third rectangular panel 824 (not shown). The third rectangular panel 824 may be orthogonally attached at upper and lower corners of an opposing vertical side to the upper and lower corners of a vertical side for a fourth rectangular panel 826 (not shown). A fourth rectangular panel 826 may be orthogonally attached at upper and lower corners of an opposing side to the upper and lower corners of an opposing side for the first panel 810. Each of the second 822, third 824, and fourth 826 rectangular panels may also be attached at opposing ends to a column of the horizontal members 808 near the mid-point of the axis the particular panel. In one exemplary embodiment, each rectangular panel is capable of holding three full-facing greeting cards in the pockets 812.

The full-facing pockets 812 may also include a graphic 826 which may be inserted at the intersection of the front member 818 and bottom member 820 of the pocket 812. The graphic 826 may provide information relating to the card's occasion, the Sender's ID associated with the card, or the text presented by the card's interior. The display assembly 800 of FIG. 8 also includes a conical graphic assembly 828 having its lowest point at or near the uppermost point of the first 810, second 822, third 824, and fourth 826 panels and its uppermost point at or near the lowermost point of a cylindrical overhead marquee 734. The conical graphic assembly 828 typically has a smaller radius at its lowermost point and expands to have a greater radius at its uppermost point.

The conical graphic assembly 828 includes a second 830 and third 832 circular member, the second circular member 830 being predisposed below the third circular member 832. The second circular member 830 may be orthogonally attached to the cylindrical base 806 by on or more horizontal members 834 (not shown). The third circular member 832 may be orthogonally attached to the cylindrical base 806 by horizontal members 836 (not shown) attached at one end to the inside diameter of the circular member 832 and attached on an opposing end to the outside circumference of the cylindrical base 806. The conical graphic assembly 828 includes one or more receptacles 838 (not shown) at the second 830 and third 832 circular members. One or more graphics 840 may be slidably inserted, or snapped, into the conical graphic assembly 828. The conical graphic assembly 828 typically provides information related to the Sender's ID for cards held in the display assembly 800, the occasion associated with the displayed cards, or pictures and/or graphics intended to generate an emotional appeal to consumers.

The display assembly of FIG. 8 may also include a cylindrical overhead marquee 734. The cylindrical overhead marquee 734 typically has a radius substantially equal to the radius of the accent floor 702 and substantially greater than the radius of the cylindrical base 806. The cylindrical overhead marquee 734 typically includes a top circular member 736 and a bottom circular member 738, each having receptacles 740 (not shown) so that graphics 742 may be slidably inserted, or snapped, into and between the top circular member 736 and bottom circular member 738. The graphics 742 are outward facing so that they may be seen at a distance away from the display assembly 800. The graphical design is intended to attract a consumer into the card retail area.

The cylindrical overhead marquee 734 can hold multiple graphics 742, of the circumference of the cylindrical overhead marquee 734. The graphics 742 for the cylindrical overhead marquee 734 are typically made of card or plastic stock and provide graphics or pictures that will inform people that greeting cards are available under the cylindrical overhead marquee 734. The cylindrical overhead marquee 734 is typically suspended from a ceiling (not shown) by one or more cables 744 attached between the top circular member 736 and a ceiling, roof top or other point of attachment that resides above the display assembly 800 of FIG. 8.

F. Fifth Exemplary Display Assembly

Figure 9:
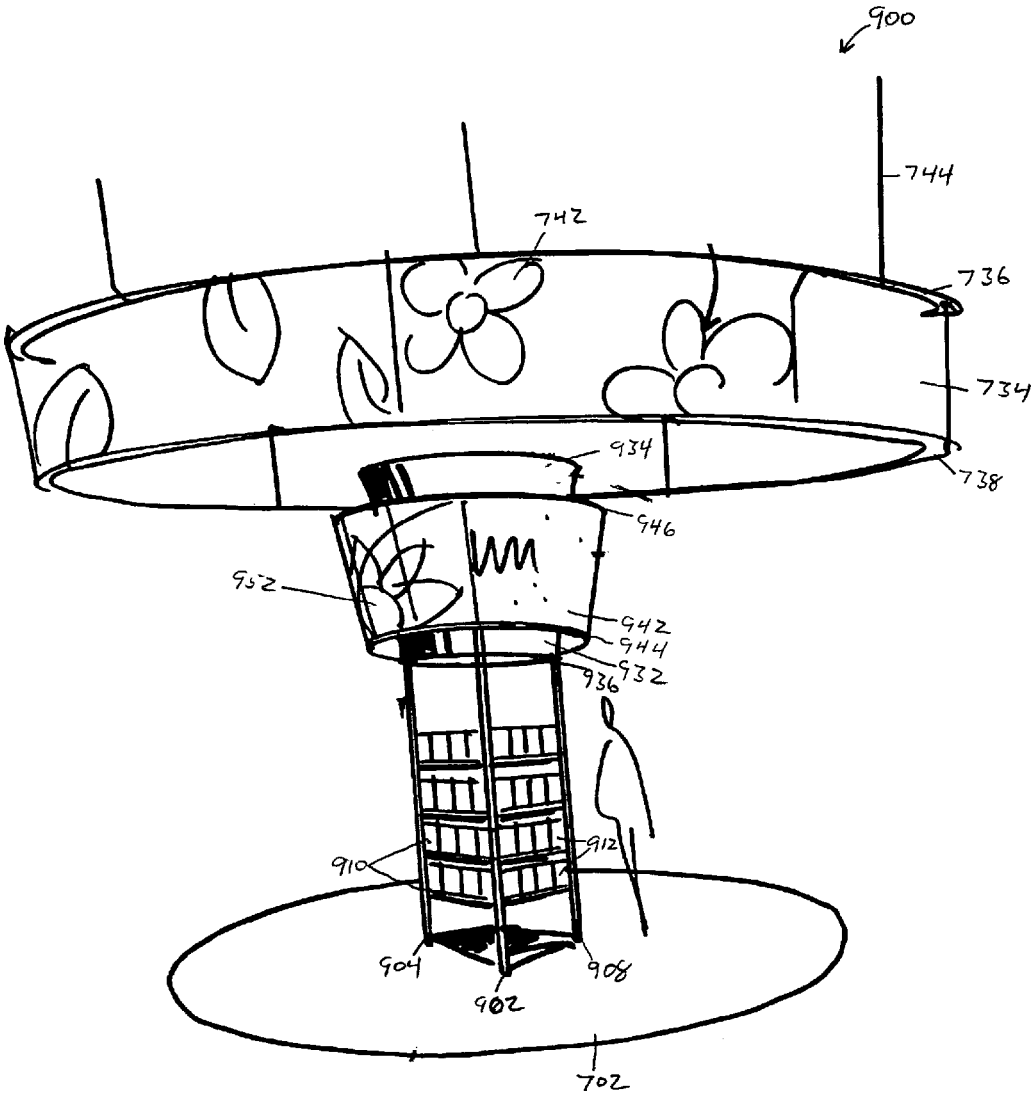
FIG. 9 illustrates another configuration for a card display area according to another exemplary embodiment of the present invention.

A detailed drawing of an alternative exemplary embodiment of the display assembly is provided in FIG. 9. Now referring to FIG. 9, the exemplary display assembly 900 includes an accent floor 702 substantially similar to that described in FIGS. 7 and 8. The display assembly 900 also includes a first 902, second 904, third 906 (not shown), and fourth 908 vertical member, each orthogonally attached at one end to, or resting upon, the accent floor 702 and extending upward in the vertical direction therefrom. The display assembly 900 also includes a first set of rows of full-facing card pockets 910, each of the first set of rows 910 orthogonally attached to the first vertical member 902 and the second vertical member 904 so that each row is substantially horizontal.

A second set of rows of full-facing pockets 912 may be attached at one end to the first vertical member 902 and at each of the row's opposing ends to the fourth vertical member 908. Each of the second set of rows of full-facing pockets 912 is positioned substantially horizontal and perpendicular to the first set of rows of full-facing pockets 910. A third set of rows of full-facing pockets 914 (not shown) may be attached to the fourth vertical member 908 and the third vertical member 906 (not shown). Each row is substantially horizontal and perpendicular to the second set of rows of full-facing pockets 912. A fourth set of rows of full-facing pockets 916 (not shown) may be attached to the third vertical member 906 (not shown) the second vertical member 904. Each row is substantially horizontal and perpendicular to the full-facing pockets 910, 914. In one exemplary embodiment, four rows of full-facing pockets are attached between each of the vertical members.

Each of the pockets includes a back member 918 (not shown), a bottom member 920 (not shown), a front member 922 (not shown), a left-side member 924 (not shown), and a right-side member 926 (not shown). Each of the rows of pockets can also include means 928 (not shown), such as tabs which may be slidably inserted into slotted portions provided on each side of the vertical members. The means 928 attach the row of pockets to the vertical members, so that the rows of pockets may be adjusted up or down along the vertical members to which they are attached. The back member 918, bottom member 920, front member 922, left-side member 924, and right-side member 926 may be made of the same or different materials. The front member 922 is typically made of a material that is clear, such as plastic.

The display assembly of FIG. 9 can also include a first conical graphics panel 932 having an upper circular member 934 and a lower circular member 936. The upper circular member 934 typically has a diameter greater than that of the lower circular member 936. The diameter of the lower circular member 936 is substantially equal to the distance from the first vertical member 902 to the third vertical member 906 (not shown), or the second vertical member 904 to the fourth vertical member 908, each being the same distance. The first conical graphics panel 932 can be attached to the display assembly 900 by multiple horizontal members 938 orthogonally attached on one end to one of the vertical members and extending outward along the horizontal plane and orthogonally attached on the other end to the lower circular member 936. The upper circular member 934 and the lower circular member 936 may also include receptacles 940 (not shown) so that graphics can be slidably inserted, or snapped into the first conical graphics panel 932.

The display assembly of FIG. 9 also includes a second conical graphics panel 942 positioned around the first conical graphics panel 932 and having a lower circular member 944 and an upper circular member 946. The lower circular member 944 has a diameter substantially larger than that of the diameter of the lower circular member 936 but less than that of the diameter of the upper circular member 946. The upper circular member 946 has a diameter substantially greater than that of the diameter of the upper circular member 934, so the second conical graphics panel 942 may fit outside of and around the first conical graphics panel 932. The second conical graphics panel 942 can be orthogonally attached to the display assembly 900 by using multiple horizontal members 948 (not shown). Each of the horizontal members 948 is orthogonally attached to one of the vertical members and extends outward along the horizontal plane for attachment to the second conical graphics panel 942.

The second conical graphics panel may also include receptacles 950 (not shown) at the upper circular member 946 and lower circular member 944 so that graphics 952 can be slidably inserted, or snapped, into the second conical graphics panel 942. In one exemplary embodiment, the graphic 952 includes information related to the Sender's ID, the occasion associated with the displayed cards, or pictures and graphics that are intended to generate an emotional appeal that is typically associated with a card's occasion.

The display assembly of FIG. 9 may also include a cylindrical overhead marquee 734. The cylindrical overhead marquee 734 typically has a radius substantially equal to the radius of the accent floor 702. The cylindrical overhead marquee 734 typically includes a top circular member 736 and a bottom circular member 738, each having receptacles 740 (not shown) so that graphics 742 may be slidably inserted, or snapped, into and between the top circular member 736 and bottom circular member 738. The graphics 742 are typically outward facing so that they may be seen at a distance away from the display assembly 900. The graphical design is intended to attract a consumer into the card retail area.

The cylindrical overhead marquee 734 can hold multiple graphics 942, each occupying a certain portion of the circumference of the cylindrical overhead marquee 734. The graphics 742 are typically made of card or plastic stock and provide graphics or pictures that are useful for informing people that greeting cards are available under the cylindrical overhead marquee 734. The cylindrical overhead marquee 734 is typically suspended from a ceiling (not shown) by one or more cables 744 between the top circular member 736 and a ceiling, roof top, or other point of attachment above the display assembly 900 of FIG. 9.

II. Marketing Methods for Greeting Cards

A. Floor Layouts

Figure 10:
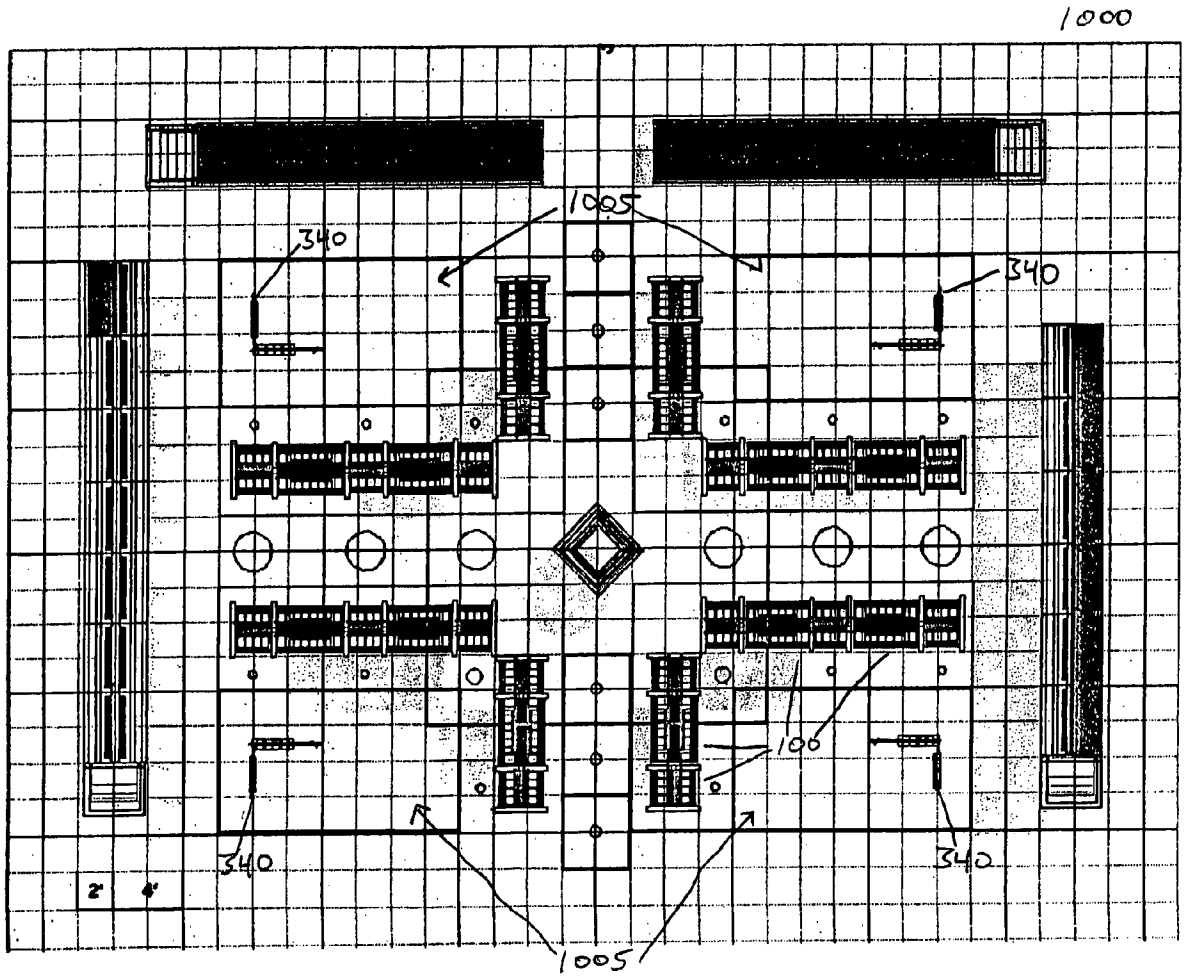
FIG. 10 illustrates an overhead view of a floor layout for a card display area according to another exemplary embodiment of the present invention.

FIG. 10 provides a detailed drawing of an exemplary floor plan layout 1000 using the first and second exemplary card display assemblies. Now referring FIG. 10, an overhead view of a card retail area is provided. It can be observed that the L-shaped, second exemplary card display assemblies 340 have been strategically positioned on the outer corners of the card display area. It can also be seen that the card retail area has been divided into four substantially equal sections 1005. These sections correspond to the four Sender's ID's. For each Sender's ID section, the area is generally populated with multiple first exemplary card display assemblies 100 and a single L-shaped, second exemplary card display assembly 340.

1. Sender's ID

The Sender's ID concept is a merchandising principle based on the realization that a person purchases a greeting card based on the sender's personal interest in the card design and the sender's belief that the recipient is likely to enjoy receiving a card bearing that design. In particular, the focus of a Sender's ID is the consumer—the sender of the card—rather than the recipient. The Sender's ID concept recognizes that a consumer is unlikely to make a greeting card purchase unless that consumer has a strong personal interest in the card design. Furthermore, research suggests that a person will typically buy cards having the same voice each time they make a purchase if cards having the sender's desired voice are available in the retail area for the particular card occasion.

A card's voice is defined by the characteristics of the greeting card, including but not limited to, the artistic designs for the front, inside, and back of the card; the design of the card; the message copy on the front, inside, and back of the card; the style of the card; and various other aspects of the card. Cards with the same voice have a consistent collection of attributes. By organizing an inventory of cards based on consumer preferences and pointing the consumer to the location of cards with a voice that appeals to that consumer, the greeting card seller will assist the consumer in achieving a more efficient and convenient card buying experience.

Consequently, the Sender's ID concept supports the separation or division of cards having a particular voice or type associated with particular consumer preferences from the total collection of cards. Display assemblies, preferably positioned in a central location within a retail environment, can present card types based on the organizational methodology of Sender's ID categories to assist the consumer in readily finding greeting cards that match the personal interests or voice of that consumer.

By organizing a greeting card fixture layout based on the concept of Sender's IDs, the consumer is more likely to find a card of interest, have a more enjoyable purchasing experience, and be likely to make additional card purchases while they are in the card retail area. In addition, the design of new greeting cards can focus on the personal interests or desired card voice for that group of consumers for each of the sender categories to further improve a consumer's shopping experience in the card retail area. By way of a representative example, the majority of card-buying consumers can be assigned to one of four distinct groups, or Sender's IDs: classic, contemporary, funny, and sweet & simple. However, those of ordinary skill in the art will recognize that, while the exemplary embodiment describes a department having four Sender's ID zones, a greater or fewer number of Sender's ID zones could be presented in a greeting card department based on a determination of the number of groups of card consumers that a manufacturer or retailer wishes to target.

Figure 13:
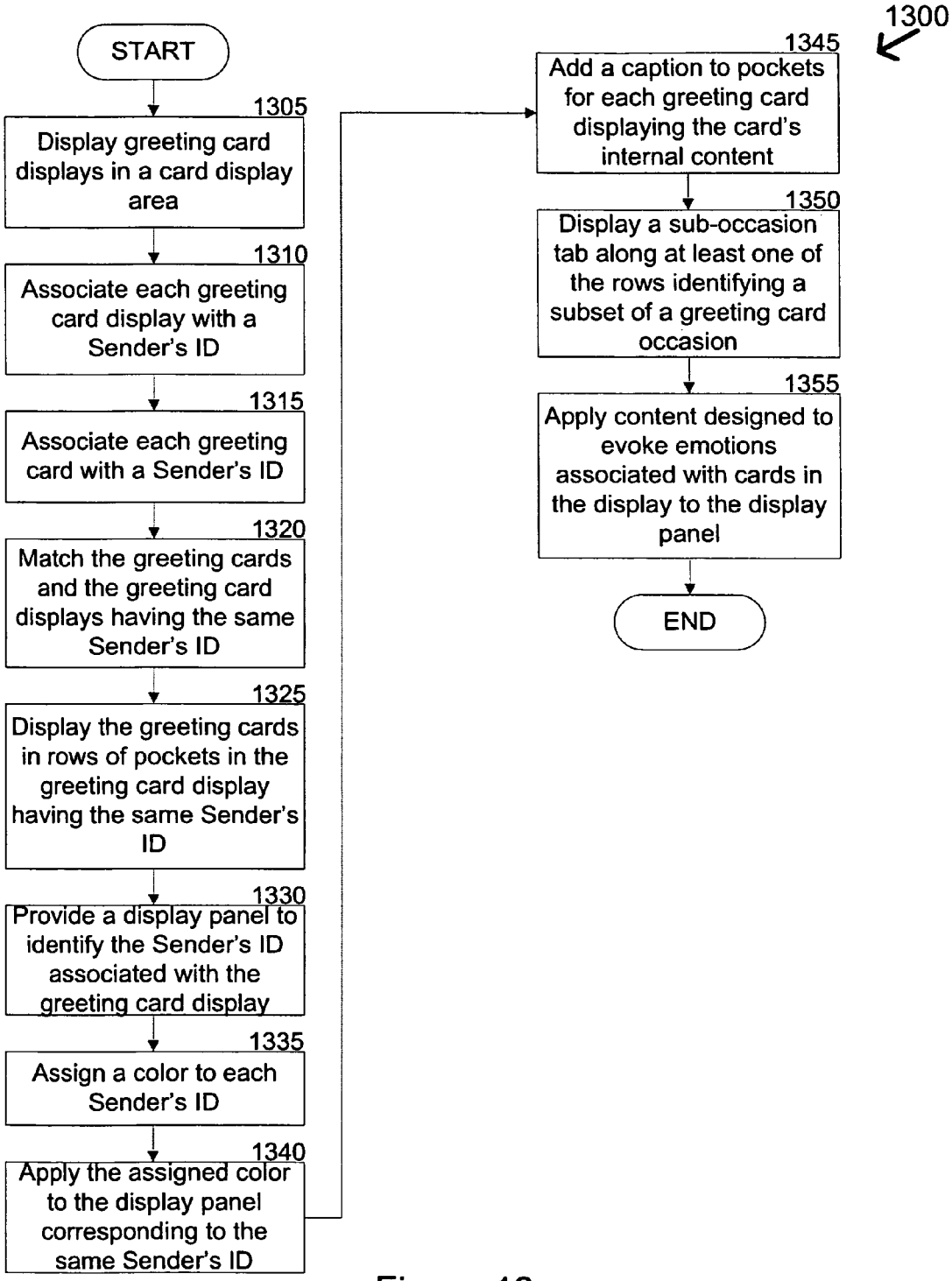
FIG. 13 is a flowchart illustrating a process for organizing and displaying greeting cards by Sender's ID in accordance with an exemplary embodiment of the present invention.

FIG. 13 is a logical flowchart diagram presented to illustrate the steps of an exemplary process 1300 for organizing and displaying greeting cards by Sender's ID within the exemplary fixture 100 of FIG. 1. Now referring to FIG. 13, the exemplary method 1300 begins at the START step and proceeds to step 1305, where greeting card display fixtures 100 are positioned throughout a card display area. As described in FIGS. 1-9, each card display panel of the display fixture 100 typically includes multiple rows of pockets for displaying greeting cards. In step 1310, each display fixture is associated with a Sender's ID. An inventory of greeting cards is analyzed and each card is associated with one or more Sender's IDs in step 1315.

In step 1320, greeting cards and display fixtures associated with the same Sender's ID are matched together and the cards are displayed in the display fixture in step 1325. In one exemplary embodiment, the greeting cards may be displayed in a full-facing or partial facing manner, or a combination of both in the display fixture 100. In step 1330, a Sender's ID display panel is provided for one or more of the display fixtures 100 and positioned so that it can be seen by consumers in the card retail area to alert them that the display fixture 100 is associated with the Sender's ID. For example, the Sender's ID display panel can be hung from the ceiling, generally above the display fixture 100, or positioned along the top of the fixture 100. A color is assigned to each Sender's ID in step 1335. The color association further assists consumers in identifying display fixtures associated with a particular Sender's ID. The assigned color is applied to the Sender's ID display panel corresponding to that Sender's ID for each fixture 100 in step 1340.

An internal copy caption is added to a portion of the rows of pockets adjacent to each unique greeting card design in step 1345. In one exemplary embodiment, internal copy captions can be provided in all of the pockets in a row and for all rows in a display fixture 100. In another exemplary embodiment, internal copy captions can be provided to one or more of the pockets in a row for one or more rows of the display fixture 100. In yet another exemplary embodiment, internal copy captions can be provided in all of the pockets in a row and for all rows that present cards in a full-facing manner in the display fixture 100. In one exemplary embodiment, the caption displays the copy or words on the inside of the greeting card. The caption can also include an occasion or sub-occasion display that identifies the occasion or sub-occasion to which the greeting card is associated. In one exemplary embodiment, the internal copy caption is a footer placed in the pocket and in front of each unique greeting card design.

In step 1350, a tab is positioned along one or more rows identifying a sub-occasion associated with the greeting cards presented in that row of pockets. Content designed to evoke emotions associated with the occasion of cards in the fixture 100 is applied to the display panel in step 1355. The objective of the content is to encourage the consumer to enter a card-buying mood as she approaches the card display fixture 100. The content typically attracts the attention of consumers through graphics, pictures and text intended to evoke emotions associated with the cards organized under the Sender's ID and displayed in the exemplary display assembly 100. The process continues from step 1355 to the END step.

2. Quickshop

In the exemplary card retail area, the card displays are separated into four Sender's ID zones 1005. One or more overhead graphics is provided in the card retail area signaling to the consumer the location of each of the four Sender's ID zones 1005. One or more Quickshop concepts can be provided on an apparatus 340 along the perimeter of the card retail area. For each Quickshop concept, a header graphic is preferably provided with the "Quickshop" name to alert the consumer that this is an area where there is an increased probability that they can quickly select cards for multiple occasions without having to enter the main portion of the card retail area. The Quickshop-based apparatus 340 is typically placed on the perimeter of each of the Sender's ID zones 1005 in order to attract consumers who were not considering buying a card today but may be convinced to make an impulse buy if they can do so in a quick, efficient manner.

Figure 11A:
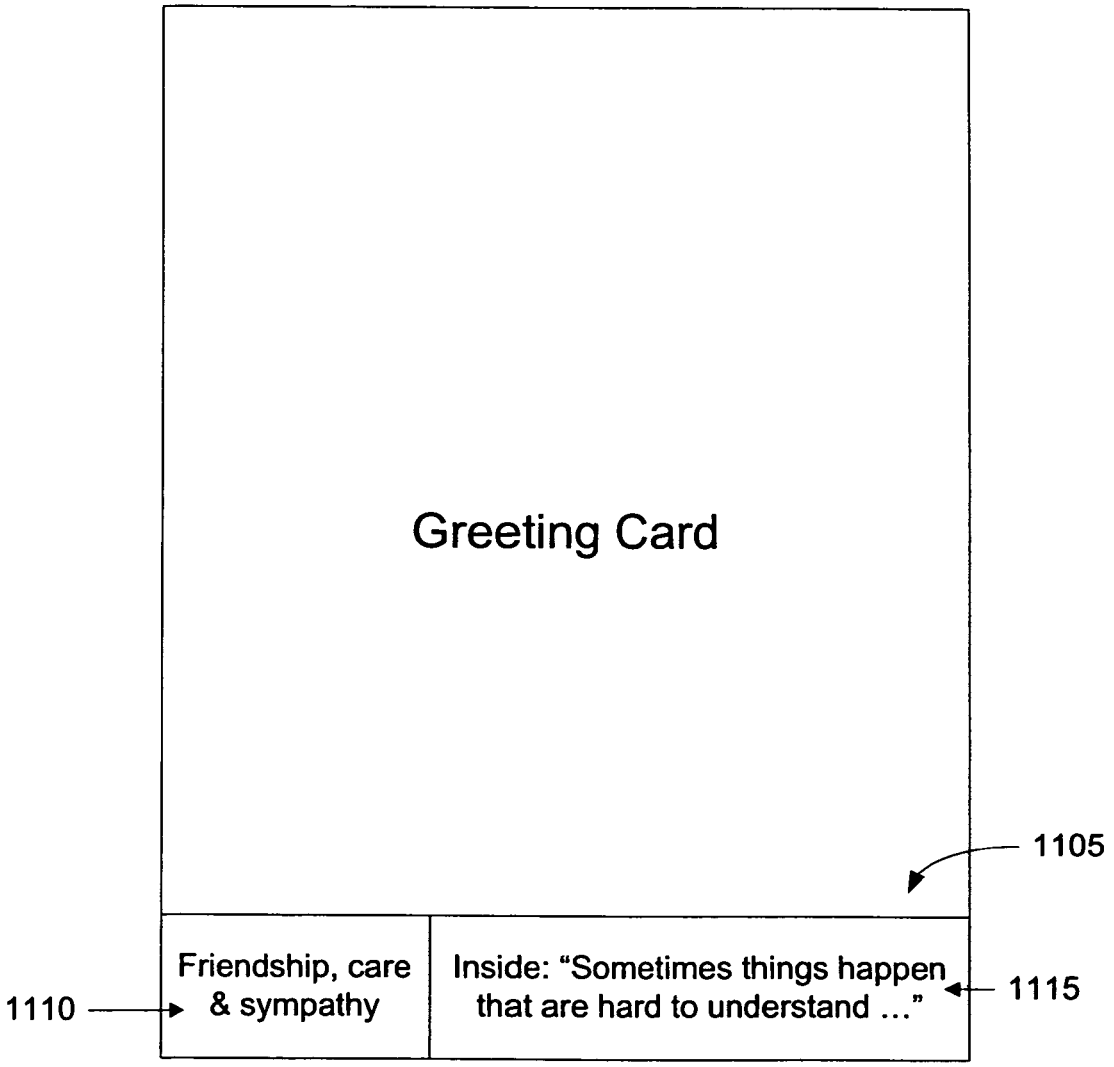
FIGS. 11A-C illustrate Quickshop components in a card display rack according to another exemplary embodiment of the present invention.
Figure 11B:
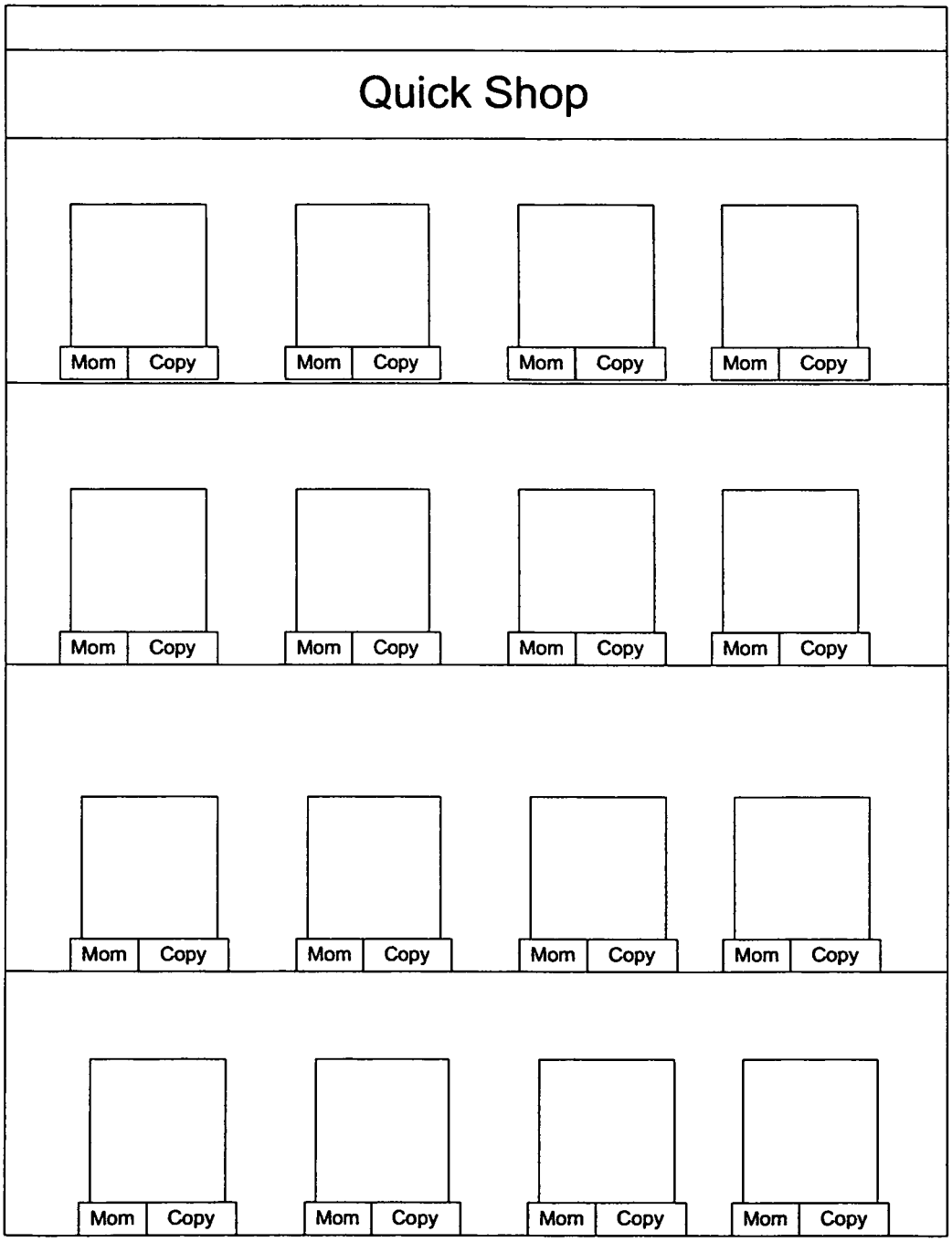
Figure 11C:
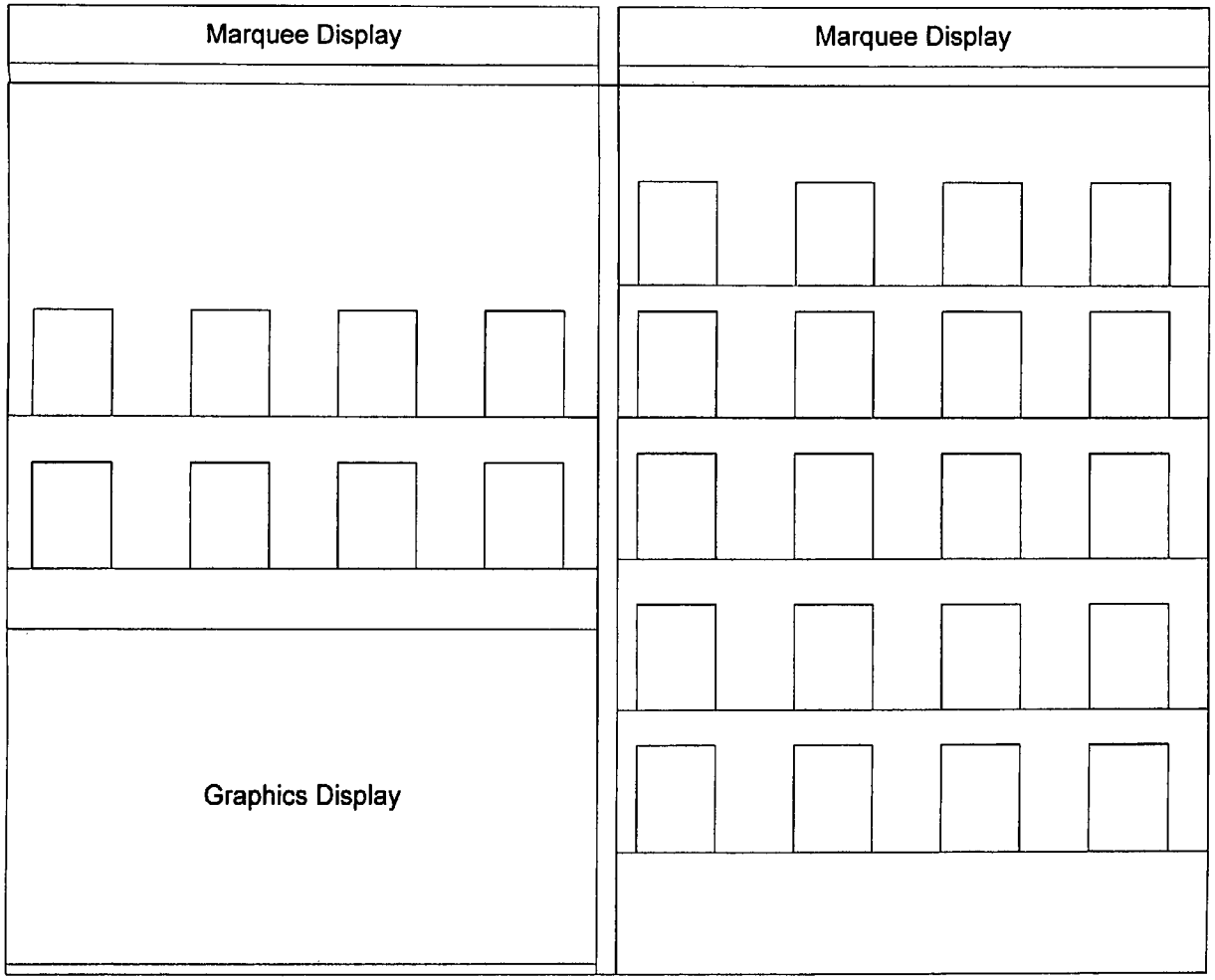

A curated selection of cards for a particular Sender's ID is provided and displayed on an exemplary Quickshop display. The selection is denoted as curated because the Quickshop display has a significantly reduced selection of cards from the Sender's ID pool of cards, in order to reduce the amount of time a consumer has to invest to see all of the cards on the apparatus. Furthermore, the cards that are displayed on the Quickshop display cover multiple occasions (i.e. Birthday, Anniversary, Wedding, Thank you, etc.) in order to generate cross-occasion sales. The curated selection is laid out in rows of full-faced cards to allow the consumer to more quickly scan through the cards and make a quick purchase. A footer 1105 is included for each of the full-faced cards, the footer providing information on the subset of the occasion 1110 (i.e. His Birthday, Her Birthday, etc.) and the text that is found inside the card 1115, as shown in FIG. 11A. By providing a copy of the inside text in the footer, the consumer can complete there card selection more quickly.

A second grouping of apparatus 100 for each Sender's ID 1005 are provided on the interior of the card retail area. The name of the Sender's ID is provided on the concave graphic of each apparatus 100 to attract the consumer to the correct Sender's ID zone 1005. The cards in each Sender's ID zone 1005 are organized vertically by occasion in order to create a sense of comfort in the consumer that they know where things will be located. Multiple rows of full-faced cards are provided at the eye level of the consumer because eye level is the area that a consumer will typically look first. By displaying cards in a full-facing manner, it highlights the artistic beauty of the cards and signals to the consumer that these cards may be uniquely suited to the occasion they are buying for under the Sender's ID. For each of the full-facing cards on the multiple rows at or near eye level, footer graphics are provided for each card. The footer graphic typically provides the major and minor captions that the card falls under, thereby quickly providing the consumer with information as to the type of card receiver that the card is best suited. The remainder of the cards for each particular Sender's ID in the apparatus 100 below the top few rows are provided in a partial-faced display format to increase the selection available to the consumer for each occasion under the Sender's ID.

Figure 14:
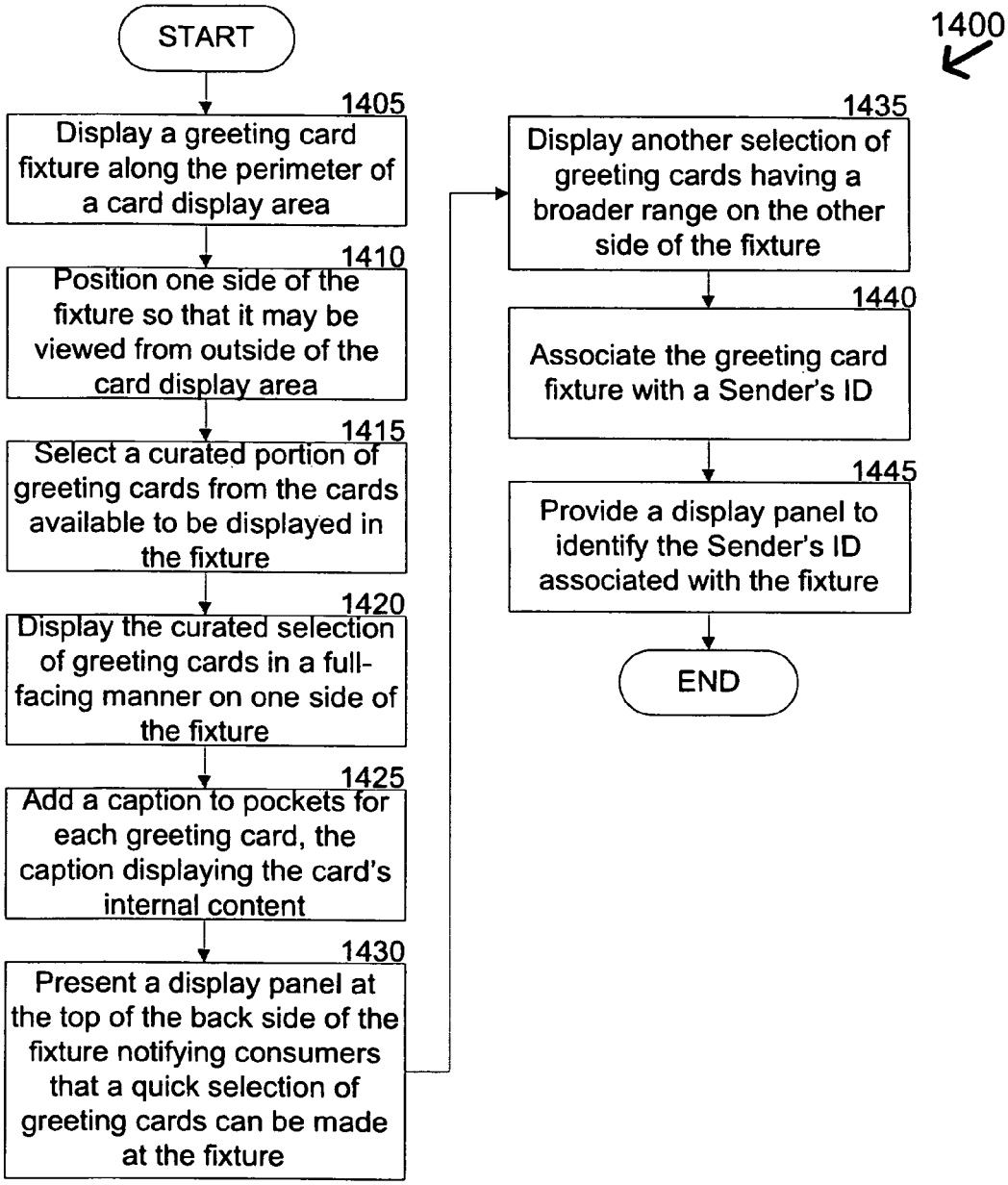
FIG. 14 is a flowchart illustrating a process for positioning a greeting card display in a card retail area and selecting and displaying a limited range of greeting cards to elicit an impulsive purchase in accordance with an exemplary embodiment of the present invention.

FIG. 14 is a logical flowchart diagram presented to illustrate the steps of an exemplary process 1400 for positioning a greeting card display in a card retail area and selecting and displaying a limited range of greeting cards to elicit an impulsive purchase, within the exemplary fixtures of FIGS. 1-9. Now referring to FIG. 14, the exemplary method 1400 begins at the START step and proceeds to step 1405 where a greeting card display fixture is positioned along the perimeter of a card display area. In one exemplary embodiment, the display fixture is a card display assembly 340 of FIG. 3C. In step 1410, one side of the display assembly 340 is positioned so that it may be viewed by a consumer when the consumer is outside of and approaching the card display area.

A curated portion of greeting cards is selected from an inventory of cards that can be displayed in the display fixture in step 1415. As described herein, the curated card selection is carefully selected to support the objective of a "QuickShop" shopping experience, which includes providing a reduced selection of cards from the collection of cards for a Sender's ID to reduce the amount of browsing time invested by a consumer in support of a card purchase. In step 1420, the curated selection of greeting cards is displayed in a full-facing manner. The cards are presented in a full-facing manner to make it easier for the consumer to see the entire front side of a greeting card and thereby reduce the number of cards that must be removed from their pocket before a card is selected for purchase.

In step 1425, an internal copy caption is added adjacent or directly in front of each unique greeting card design. In one exemplary embodiment, the caption displays the copy or words on the inside of the greeting card. The caption may also include an occasion or sub-occasion display that identifies the occasion or sub-occasion to which the greeting card is associated. A "Quickshop" display panel is presented near the top of this side of the display fixture to notify consumers that this side of the display provides a unique shopping experience in step 1430.

In step 1435, a broader and more numerous selection of greeting cards from the inventory of greeting cards is displayed on the other sides of the display assembly 340. In step 1440, the display assembly with the Quickshop display is associated with a Sender's ID. In step 1445, a Sender's ID display panel is provided for the display assembly 340 and positioned so that it can be seen by consumers inside and outside of the card retail area to alert them that the display assembly 340 is associated with the Sender's ID. For example, the Sender's ID display panel can be hung from the ceiling generally above the display assembly 340 or positioned along the top of the assembly 340. The process then continues from step 1445 to the END step.

Figure 12:
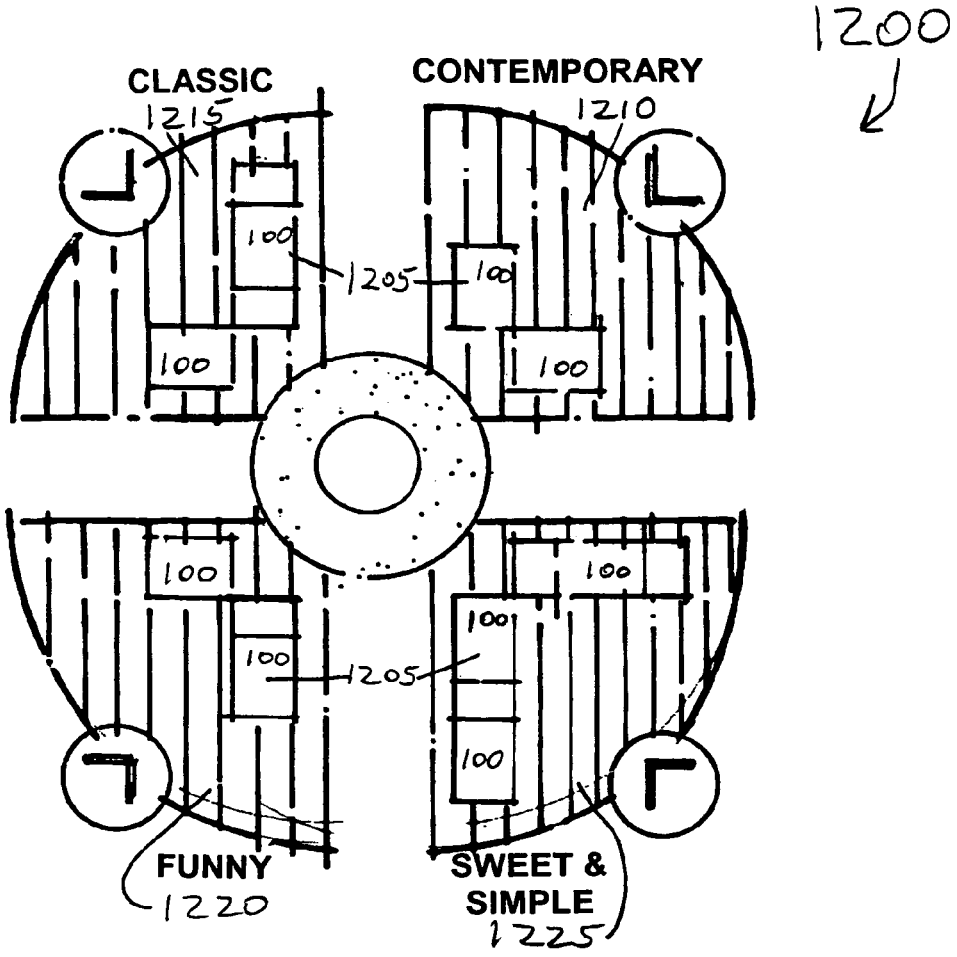
FIG. 12 illustrates an overhead view of an alternative floor layout for fixtures assigned to Sender's ID zones according to one exemplary embodiment of the present invention.

FIG. 12 provides a detailed drawing of an alternative layout of a card retail area incorporating the apparatus 100 according to an alternative embodiment of the present invention. Now referring to FIG. 12, the exemplary retail layout 1200 includes multiple groupings of displays 1205 assembled by incorporating one or more of the exemplary apparatus 100. In one exemplary embodiment, each display 1205 represents an entire card retail area 1210, 1215, 1220, 1225. A card retail area 1210, 1215, 1220, 1225 provides a presentation of cards for all of the primary card categories in only a portion of the department, where one or more fixtures organized by particular Sender's ID is located. A consumer may view a single department section, a Sender's ID zone, to review greeting cards covering most or all primary card categories, thereby reducing the amount of cards and time a consumer is required to spend in the greeting card department. The exemplary retail layout 1200 typically includes at least two displays 1205 representing different card retail areas 1210, 1215, 1220, 1225. Each card retail area 1210, 1215, 1220, 1225 typically represents one of the Sender's ID zones. Each card retail area 1210, 1215, 1220, 1225 preferably contains all categories and subcategories of greeting cards represented in a typical retail greeting card area (birthday, wedding, special occasion, etc.) to enable a consumer to find greeting cards to meet all of their needs within a single display 1205 presenting cards organized under a particular Sender's ID. In one exemplary embodiment, each display 1205 includes a single apparatus 100 containing all categories and subcategories of greeting cards represented in a typical retail greeting card area.

As shown, each card retail area 1210, 1215, 1220, 1225 could operate independently to satisfy the card buying requirements of consumers because each area presents greeting cards representing the primary categories and subcategories of cards for a typical retail environment, all organized under a designated Sender's ID. In one exemplary embodiment, each display 1205 in each of the card retail areas 1210, 1215, 1220, 1225 is nearly identical to other displays in that card retail area or in another card retail area. In this manner. consumers can encounter the same or substantially similar presentations of greeting cards in each area, thereby creating a more enjoyable card buying experience. Those of ordinary skill in the art will recognize that, due to space constraints in a store or layout area 1200, the number of displays 1205 in each card retail area 1210, 1215, 1220, 1225 and the size of each display 1205 may be modified to fit into the layout area without significantly altering the advantages of the described layout. Those of ordinary skill in the art will also recognize that while the exemplary layout shown in FIG. 12 presents four card retail areas 1210, 1215, 1220, 1225 the advantages described herein can be achieved by having two or more card retail areas in the layout area 1200.

Figure 15:
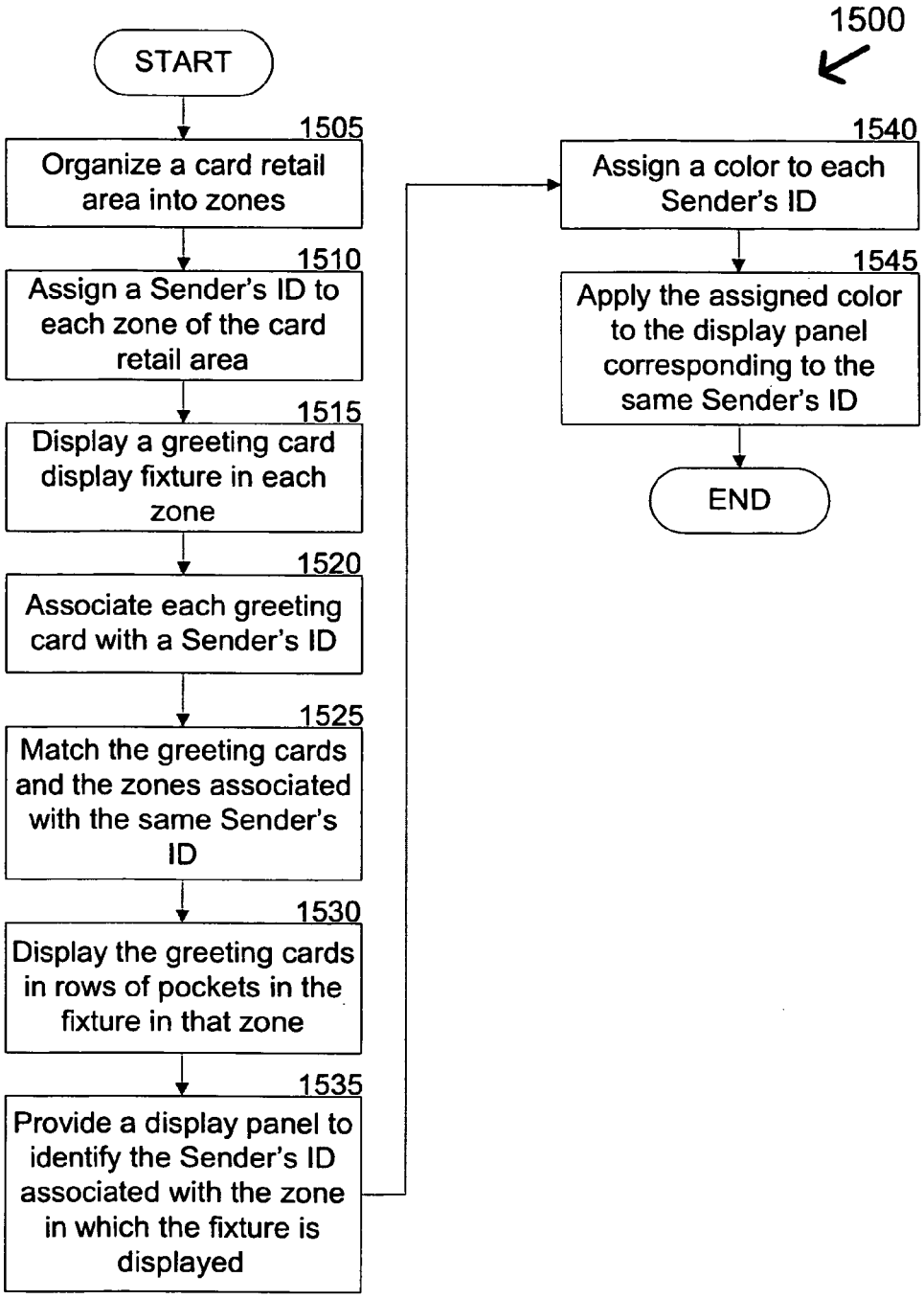
FIG. 15 is a flowchart illustrating a process of organizing a card retail area into zones and displaying cards associated with a different Sender's ID in each zone in accordance with an exemplary embodiment of the present invention.

FIG. 15 is a logical flowchart diagram presented to illustrate the steps of an exemplary process 1500 for organizing a card retail area into zones and displaying cards associated with a different Sender's ID in each zone within the exemplary fixtures of FIGS. 1-9. Referring to FIG. 15, the exemplary method 1500 begins at the START step and proceeds to step 1505, where a card retail area is organized into zones. Each zone does not have to have any particular shape, and the size of the zone can be different from the size of other zones in the card retail area. A Sender's ID is assigned to each zone in the card retail area in step 1510.

In step 1515, display fixtures are positioned in each zone. In one exemplary embodiment, the display fixtures are card display assemblies 100 of FIG. 1. An inventory of greeting cards is analyzed and each card is associated with a Sender's ID in step 1520. In step 1525, greeting cards associated with a particular Sender's ID are matched with a zone displaying that Sender's ID. The greeting cards are displayed in the display assembly 100 within that zone in step 1530. In step 1535, a Sender's ID display panel is provided for each zone and positioned so that it can be seen by consumers in and/or outside of the card retail area to alert them as to the zone associated with a particular Sender's ID. The Sender's ID display panel can be hung from the ceiling or positioned along the top of one or more of the display assemblies 100 within each zone. A color is assigned to each Sender's ID in step 1540. The color association further assists consumers in identifying the zone associated with a particular Sender's ID. The assigned color is applied to the Sender's ID display panel corresponding to that Sender's ID for each zone in the card retail area in step 1545. The process continues from step 1545 to the END step.

While there have been shown and described several exemplary embodiments of the present invention, it will be evident to those skilled in the art that various modifications and changes may be made thereto without departing from the spirit and the scope of the present invention.

We claim:

1. A display fixture for the display of greeting cards associated with one of a plurality of Sender's ID, comprising: a card display comprising pockets operative to hold the greeting cards, wherein the pockets are capable of displaying a portion of the greeting cards in a full-facing manner to display the full face of each greeting card; and a first display panel positioned generally above the tiered card display, the first display panel presenting content for identifying a Sender's ID associated with the display fixture the Sender's ID comprising an identifier for a profile defining characteristics for a segment of greeting card purchasers, each of the greeting cards associated with the Sender's ID; a second display panel positioned generally above the display fixture, the second display panel presenting content for identifying a Sender's ID for the greeting cards displayed in the fixture, wherein one of the first or second display panel faces outward from a back side of the display and the other first or second display panel faces outward from a front side of the display; wherein the display fixture is associated with one of the Sender's IDs and wherein each of the greeting cards display in the display fixture are allocated to the display fixture by matching the Sender's ID associated with the greeting card to the Sender's ID associated with the display fixture.

* * * * *